US011512888B2

(12) United States Patent
Picanço et al.

(10) Patent No.: US 11,512,888 B2
(45) Date of Patent: Nov. 29, 2022

(54) AIR PASSAGEWAYS IN A VARIABLE CLIMATE ZONE COMPARTMENT

(71) Applicant: Electrolux Do Brasil S.A., Curitiba (BR)

(72) Inventors: Guilherme Picanço, Curitiba (BR); Marcelo Campani, Curitiba (BR); Carlos Richter, Curitiba (BR); Felipe Ormelez, Curitiba (BR); Rafael Roslindo, Curitiba (BR); Israel Mercer, Curitiba (BR); Rafael Leidens, Curitiba (BR); Alcione Colecha, Curitiba (BR); Antonio Voltarelli, Curitiba (BR); Michel Werkhauser, Curitiba (BR)

(73) Assignee: Electrolux do Brasil S.A., Curitiba (BR)

( * ) Notice: Subject to any disclaimer, the term of this patent is extended or adjusted under 35 U.S.C. 154(b) by 79 days.

(21) Appl. No.: 16/977,308

(22) PCT Filed: Mar. 2, 2018

(86) PCT No.: PCT/BR2018/050052
§ 371 (c)(1),
(2) Date: Sep. 1, 2020

(87) PCT Pub. No.: WO2019/165520
PCT Pub. Date: Sep. 6, 2019

(65) Prior Publication Data

US 2021/0055033 A1 Feb. 25, 2021

(51) Int. Cl.
*F25D 17/06* (2006.01)
*F25D 23/06* (2006.01)

(52) U.S. Cl.
CPC ..... *F25D 17/065* (2013.01); *F25D 17/067* (2013.01); *F25D 23/069* (2013.01);
(Continued)

(58) Field of Classification Search
CPC .... F25D 17/065; F25D 17/067; F25D 23/069; F25D 2317/0672; F25D 2317/0681; F25D 2400/02; F25D 2317/067; F25D 2400/16
See application file for complete search history.

(56) References Cited

U.S. PATENT DOCUMENTS 93,046 A * 7/1869 Brainard ..... F25D 23/062 217/128
3,050,955 A 8/1962 Solley et al.
(Continued)

FOREIGN PATENT DOCUMENTS

EP 0383222 8/1990
EP 1806553 7/2007
(Continued)

OTHER PUBLICATIONS

International Search Report and Written Opinion for International Application No. PCT/BR2018/050052, dated Nov. 29, 2018, 9 pages.

*Primary Examiner* — Elizabeth J Martin
*Assistant Examiner* — Dario Antonio Deleon
(74) *Attorney, Agent, or Firm* — Pearne & Gordon LLP

(57) ABSTRACT

A refrigeration appliance includes a liner having a rear wall that is contoured to define a first vertical recess therein. A partition divides the compartment into an upper and a lower compartment and includes a first protrusion disposed in the first vertical recess in the liner. A first opening extends through the first protrusion and is aligned with the first vertical recess in the liner. A temperature control system is positioned in the upper compartment and includes a vertical partition. At least one lower opening extends through a front surface of the vertical partition and fluidly communicates with an upper end of the first vertical recess in the liner and
(Continued)

the first opening extending through the partition. An evaporator fan is disposed in the lower compartment.

21 Claims, 19 Drawing Sheets

(52) U.S. Cl.
CPC ..... *F25D 2317/0672* (2013.01); *F25D 2317/0681* (2013.01); *F25D 2400/02* (2013.01)

(56) References Cited

U.S. PATENT DOCUMENTS

| | | | |
|---|---|---|---|
| 3,590,911 | A | 7/1971 | Horvay |
| 4,488,412 | A | 12/1984 | Weaver et al. |
| 4,704,874 | A | 11/1987 | Thompson et al. |
| 5,228,499 | A | 7/1993 | Yoon |
| 5,392,615 | A | 2/1995 | Lim |
| 5,758,512 | A | 6/1998 | Peterson et al. |
| 5,899,083 | A | 5/1999 | Peterson et al. |
| 6,055,826 | A | 5/2000 | Hiraoka et al. |
| 6,314,746 | B2 | 11/2001 | Ohya et al. |
| 6,351,967 | B1 | 3/2002 | Adachi et al. |
| 6,497,113 | B1 | 12/2002 | Yamada et al. |
| 6,725,678 | B2 | 4/2004 | Chang et al. |
| 7,032,407 | B2 | 4/2006 | Chastine |
| 7,971,443 | B2 | 7/2011 | Nishita et al. |
| 8,074,469 | B2 | 12/2011 | Hamel et al. |
| 8,191,382 | B2 | 6/2012 | Lim et al. |
| 8,196,427 | B2 | 6/2012 | Bae et al. |
| 8,418,485 | B2 | 4/2013 | Nishita et al. |
| 8,746,005 | B2 | 6/2014 | Yoon |
| 8,806,885 | B2 | 8/2014 | Bae et al. |
| 8,845,047 | B2 | 9/2014 | Luisi et al. |
| 8,950,209 | B2 | 2/2015 | Junge et al. |
| 8,966,926 | B2 | 3/2015 | Eveland et al. |
| 9,010,145 | B2 | 4/2015 | Lim et al. |
| 9,016,077 | B2 | 4/2015 | Cho et al. |
| 9,086,234 | B2 * | 7/2015 | Gu ..... F25D 23/069 62/48 |
| 9,140,472 | B2 | 9/2015 | Shin et al. |
| 9,217,601 | B2 | 12/2015 | Koo et al. |
| 9,429,357 | B2 | 8/2016 | Cha et al. |
| 9,534,825 | B2 | 1/2017 | Eveland et al. |
| 2005/0086952 | A1 | 4/2005 | Nonaka et al. |
| 2006/0260351 | A1 | 11/2006 | Coulter et al. |
| 2007/0163289 | A1 | 7/2007 | Hahm et al. |
| 2007/0205705 | A1 | 9/2007 | Middleton et al. |
| 2008/0047294 | A1 | 2/2008 | Hasegawa |
| 2009/0235684 | A1 | 9/2009 | Hasegawa |
| 2010/0218514 | A1 * | 2/2010 | Bertolini et al. ..... F25D 11/00 62/56 |
| 2010/0223944 | A1 * | 9/2010 | Tsujimoto et al. ..... F25D 27/00 62/264 |
| 2011/0146335 | A1 | 6/2011 | Jung et al. |
| 2015/0192344 | A1 | 7/2015 | Lim et al. |
| 2015/0308730 | A1 | 10/2015 | Gu |
| 2016/0102905 | A1 * | 4/2016 | Cha et al. ..... F25D 23/06 |
| 2016/0252294 | A1 | 9/2016 | Cha et al. |
| 2017/0074580 | A1 | 3/2017 | Eveland et al. |

FOREIGN PATENT DOCUMENTS

| | | |
|---|---|---|
| EP | 2215413 | 8/2010 |
| EP | 2241844 | 10/2010 |
| EP | 2325583 | 5/2011 |
| EP | 2594871 | 5/2013 |
| JP | 10288440 | 10/1998 |
| JP | H11211319 | 8/1999 |
| JP | 2000258028 | 9/2000 |
| JP | 2002181429 | 6/2002 |
| WO | 2014049739 A1 | 4/2014 |
| WO | 2016036005 | 3/2016 |

* cited by examiner

AIR PASSAGEWAYS IN A VARIABLE CLIMATE ZONE COMPARTMENT

This application is a U.S. National Phase application of PCT International Application No. PCT/BR2018/050052, filed Mar. 2, 2018, which is incorporated by reference herein.

CROSS-REFERENCE TO RELATED APPLICATIONS

None.

FIELD OF THE INVENTION

This application relates generally to a variable climate zone compartment for a refrigeration appliance, and more particularly, to a refrigeration appliance including flow paths for supplying warm and/or cool air to the compartment.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Some refrigerators are now made with a variable climate zone (VCZ) compartment wherein a user to select the temperature of the VCZ compartment based on the food products being stored in the VCZ compartment. In some instances, separate cooling and heating flow paths may be provided in the VCZ compartment.

The present invention provides flow paths for a VCZ compartment of a refrigerator.

BRIEF SUMMARY OF THE INVENTION

In accordance with one aspect, there is provided a refrigeration appliance including a liner defining a compartment for storing food items in a refrigerated environment. A rear wall of the liner is contoured to define a first vertical recess therein. A partition divides the compartment into an upper compartment and a lower compartment. The lower compartment having a user-selectable target freezer temperature and the upper compartment having a user-selectable target variable climate zone temperature between a predetermined temperature below 0 degrees Centigrade and a predetermined temperature above 0 degrees Centigrade. The partition includes a first protrusion extending from a rear edge of the partition. The first protrusion is disposed in the first vertical recess in the liner when the partition is positioned in the compartment. A first opening extends through the first protrusion from an upper surface of the partition to a lower surface of the partition. The first opening is aligned with the first vertical recess in the liner. A temperature control system is positioned in the upper compartment. The temperature control system includes a vertical partition having a front surface and a rear surface. The rear surface faces the rear wall of the liner and the front surface faces an open end of the upper compartment. At least one lower opening extends through the front surface of the vertical partition and fluidly communicates with an upper end of the first vertical recess in the liner and the first opening extending through the partition. An evaporator is disposed in the lower compartment. An evaporator fan is disposed in the lower compartment for drawing air from the upper compartment through the at least one lower opening in the vertical partition through the first vertical recess in the liner and through the first opening extending through the partition and exhausting the air into the lower compartment.

In the refrigeration appliance, a U-shape air duct may be positioned in the lower compartment over the first vertical recess to enclose a portion of the first vertical recess in the lower compartment.

In the refrigeration appliance, the U-shape air duct may be positioned between the evaporator and the rear wall of the liner.

In the refrigeration appliance, the partition may be a not foamed partition wall. A "foamed" partition refers to a partition that is filled with foam during a foaming process that includes injecting foam between an inner and outer casing of a refrigeration appliance. In contrast, an "un-foamed" or "not foamed" partition refers to a partition that is filled with an insulating material separate and independent of the foaming process of the inner and outer casing of the refrigeration appliance. The un-foamed or not foamed partition may be secured to the liner before or after the aforementioned foaming process.

In the refrigeration appliance, the liner may further define a second compartment disposed above the compartment and a foamed second partition wall that separates the second compartment from the compartment.

In the refrigeration appliance, the second compartment may be a fresh food compartment.

In the refrigeration appliance, the liner may include a second vertical recess. The partition may include a second protrusion extending from a rear edge of the partition. The second protrusion may be disposed in the second vertical recess in the liner when the partition is positioned in the compartment. A second opening may extend through the second protrusion from the upper surface of the partition to the lower surface of the partition. The second opening may be aligned with the second vertical recess in the liner. The temperature control system may include an air passage formed in the vertical partition extending from a lower portion of the vertical partition to an upper portion of the vertical partition. A lower end of the air passage may be aligned with the second opening in the partition between the upper compartment and the lower compartment. At least one upper opening may extend through the front surface of the vertical partition to an upper end of the air passage. The evaporator fan disposed in the lower compartment may convey cooling air from the evaporator through the second opening in the partition, through the air passage in the vertical partition and through the at least one upper opening in the vertical partition and exhaust the cooling air into the upper compartment.

In the foregoing refrigeration appliance, a damper assembly may be positioned proximate the lower end of the air passage. The damper assembly may include a frame assembly defining a damper air passage through the damper assembly fluidly communicating with the second opening formed in the partition. A door may be rotatably attached to the frame assembly. The door may be moveable between a first position and a second position. When the door is in the first position the door fluidly isolates the second opening in the partition from the upper compartment while allowing a lower inlet opening in the vertical partition to fluidly communicate with the air passage in the vertical partition. When the door is in the second position the door fluidly isolates the lower inlet opening in the vertical partition from the air passage in the vertical partition while allowing the second opening in the partition to fluidly communicate with the upper compartment.

In the foregoing refrigeration appliance, a first seal member is disposed between the frame assembly and the door when the door is in the first position and a second seal member is disposed between the vertical partition and the door when the door is in the second position.

In the foregoing refrigeration appliance, the air passage may form a closed loop circulation path with the upper compartment when the door is in the first position.

In the foregoing refrigeration appliance, the air passage may direct cooled air into the upper compartment from the evaporator when the door is in the second position.

In the refrigeration appliance, a circulation fan may be positioned in the air passage for conveying air therealong.

In the foregoing refrigeration appliance, the circulation fan may be aligned with the lower end of the air passage and may be arranged between a lower inlet opening and an upper outlet opening extending through the front surface of the vertical partition to the air passage.

In the refrigeration appliance, a heater assembly may be disposed between the front surface and the rear surface of the vertical partition proximate the air passage wherein air in the air passage is heated by the heater assembly when the heater assembly is energized.

In the refrigeration appliance, a rear portion of the vertical partition may extend into the second vertical recess and a corresponding surface of the liner may define a boundary of the air passage through the vertical partition.

In the refrigeration appliance, the heater assembly may include a formed electrical coil.

In the refrigeration appliance, the heater assembly may be overmolded into the vertical partition.

In the refrigeration appliance, an air passage may be defined by a plurality of walls extending from the rear surface of the vertical partition and the rear wall of the liner. The plurality of walls may have distal ends that abut the rear wall of the liner.

In the refrigeration appliance, a seal may be positioned between the distal ends of the plurality of walls and the rear wall of the liner for sealing enclosing air passage.

In the refrigeration appliance, the air passage may be defined by an enclosed opening extending between the front surface and the rear surface of the vertical partition.

In the refrigeration appliance, the air passage may define a closed loop circulation path with the upper compartment.

In the refrigeration appliance, the vertical partition may include a cover and a body coupled to the cover to define the air passage in the vertical partition.

In the refrigeration appliance, a heater assembly may be positioned between the cover and the body.

In the refrigeration appliance, the cover for the vertical partition may be made of a plastic material and the body of the vertical partition may be made of expanded polystyrene.

In the refrigeration appliance, the air passage may extend through the body of the vertical partition for directing air heated by the heater assembly into the upper compartment in a closed loop.

In the refrigeration appliance, the cover of the vertical partition may include at least one inlet opening and at least one outlet opening both fluidly communicating with the air passage in the body of the vertical partition.

In accordance with another aspect, there is provided a refrigeration appliance including a liner defining a compartment for storing food items in a refrigerated environment. A rear wall of the liner is contoured to define a vertical recess therein. A partition divides the compartment into an upper compartment and a lower compartment. The lower compartment has a user-selectable target freezer temperature and the upper compartment has a user-selectable target variable climate zone temperature between a predetermined temperature below 0 degrees Centigrade and a predetermined temperature above 0 degrees Centigrade. The partition includes a protrusion extending from a rear edge of the partition. The protrusion is disposed in the vertical recess in the liner when the partition is positioned in the compartment. An opening extends through the protrusion from an upper surface of the partition to a lower surface of the partition. The opening is aligned with the vertical recess in the liner. A temperature control system is positioned in the upper compartment. The temperature control system includes a vertical partition having a front surface and a rear surface. The rear surface faces the rear wall of the liner and the front surface faces an open end of the upper compartment. An air passage is formed in the vertical partition extending from a lower portion of the vertical partition to an upper portion of the vertical partition. A lower end of the air passage is aligned with the opening in the partition between the upper compartment and the lower compartment. At least one upper opening extends through the front surface of the vertical partition to an upper end of the air passage. An evaporator is disposed in the lower compartment. An evaporator fan is disposed in the lower compartment for conveying cooling air from the evaporator through the opening in the partition, through the air passage in the vertical partition and through the at least one upper opening in the vertical partition and exhausting the cooling air into the upper compartment.

In the refrigeration appliance, a circulation fan may be positioned in the air passage for conveying air therealong.

In the foregoing refrigeration appliance, the circulation fan may be aligned with the lower end of the air passage and may be arranged between a lower inlet opening and an upper outlet opening extending through the front surface of the vertical partition to the air passage.

In the refrigeration appliance, a heater assembly may be disposed between the front surface and the rear surface of the vertical partition proximate the air passage wherein air in the air passage is heated by the heater assembly when the heater assembly is energized.

In the refrigeration appliance, the partition may be a not foamed partition wall.

In the refrigeration appliance, the liner may define a second compartment disposed above the compartment and a foamed second partition wall that separates the second compartment from the compartment.

In the foregoing refrigeration appliance, the second compartment may be a fresh food compartment.

In the refrigeration appliance, a rear portion of the vertical partition may extend into the vertical recess and a corresponding surface of the liner may define a boundary of the air passage through the vertical partition.

In the refrigeration appliance, the liner may include an additional vertical recess. The partition may include an additional protrusion extending from a rear edge of the partition. The additional protrusion may be disposed in the additional vertical recess in the liner when the partition is positioned in the compartment. An additional opening may extend through the additional protrusion from an upper surface of the partition to a lower surface of the partition. The additional opening may be aligned with the additional vertical recess in the liner. The temperature control system may include at least one lower opening extending through the front surface of the vertical partition and fluidly communicating with an upper end of the additional vertical recess in the liner and the additional opening extending through the partition. The evaporator fan disposed in the lower compartment may draw air from the upper compartment through the at least one lower opening in the vertical partition, through the additional vertical recess in the liner and through the additional opening extending through the partition and exhaust the air into the lower compartment.

In the foregoing refrigeration appliance, a U-shaped air duct may be positioned in the lower compartment over the additional vertical recess to enclose a portion of the additional vertical recess in the lower compartment.

In the foregoing refrigeration appliance, the U-shaped air duct may be positioned between the evaporator and the rear wall of the liner.

In the foregoing refrigeration appliance, a damper assembly may be positioned proximate the lower end of the air passage. The damper assembly may include a frame assembly defining a damper air passage through the damper assembly fluidly communicating with the opening formed in the partition. A door may be rotatably attached to the frame assembly. The door may be moveable between a first position and a second position. When the door is in the first position the door fluidly isolates the opening in the partition from the upper compartment while allowing a lower inlet opening in the vertical partition to fluidly communicate with the air passage in the vertical partition. When the door is in the second position the door fluidly isolates the lower inlet opening in the vertical partition from the air passage in the vertical partition while allowing the opening in the partition to fluidly communicate with the upper compartment.

In the foregoing refrigeration appliance, a first seal member is disposed between the frame assembly and the door when the door is in the first position and a second seal member is disposed between the vertical partition and the door when the door is in the second position.

In the foregoing refrigeration appliance, the air passage may form a closed loop circulation path with the upper compartment when the door is in the first position.

In the foregoing refrigeration appliance, the air passage may direct cooled air into the upper compartment from the evaporator when the door is in the second position.

In the refrigeration appliance, the heater assembly may include a formed electrical coil.

In the refrigeration appliance, the heater assembly may be overmolded into the vertical partition.

In the refrigeration appliance, an air passage may be defined by a plurality of walls extending from the rear surface of the vertical partition and the rear wall of the liner. The plurality of walls may have distal ends that abut the rear wall of the liner.

In the refrigeration appliance, a seal may be positioned between the distal ends of the plurality of walls and the rear wall of the liner for sealing enclosing air passage.

In the refrigeration appliance, the air passage may be defined by an enclosed opening extending between the front surface and the rear surface of the vertical partition.

In the refrigeration appliance, the air passage may define a closed loop circulation path with the upper compartment.

In the refrigeration appliance, the vertical partition may include a cover and a body coupled to the cover to define the air passage in the vertical partition.

In the refrigeration appliance, a heater assembly may be positioned between the cover and the body.

In the refrigeration appliance, the cover for the vertical partition may be made of a plastic material and the body of the vertical partition may be made of expanded polystyrene.

In the refrigeration appliance, the air passage may extend through the body of the vertical partition for directing air heated by the heater assembly into the upper compartment in a closed loop.

In the refrigeration appliance, the cover of the vertical partition may include at least one inlet opening and at least one outlet opening both fluidly communicating with the air passage in the body of the vertical partition.

DESCRIPTION OF EXAMPLE EMBODIMENTS

Figure 1:
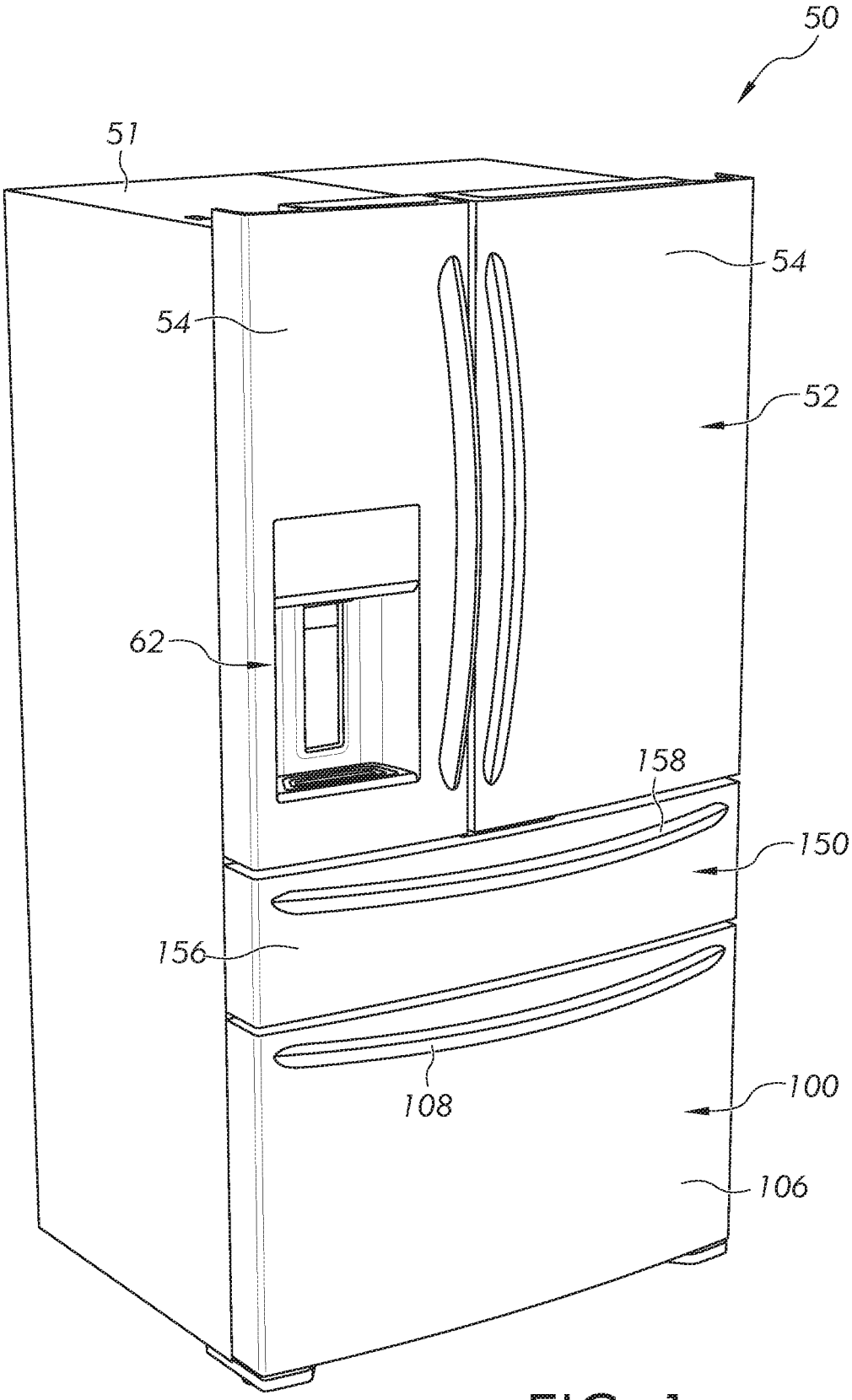
FIG. 1 is a front perspective view of a household French Door Bottom Mount refrigerator showing doors of the refrigerator and drawers of a freezer compartment and a variable climate zone compartment in a closed position.

Referring now to the drawings, FIG. 1 shows a refrigeration appliance in the form of a domestic refrigerator, indicated generally at 50. Although the detailed description that follows concerns a domestic refrigerator 50, the invention can be embodied by refrigeration appliances other than with a domestic refrigerator 50. Further, an embodiment is described in detail below, and shown in the figures as a bottom-mount configuration of a refrigerator 50, including a fresh food compartment 52 disposed vertically above a variable climate zone (VCZ) compartment 150 and a freezer compartment 100.

Two doors 54 shown in FIG. 1 are pivotally coupled to a cabinet 51 of the refrigerator 50 to restrict and grant access to the fresh food compartment 52. The doors 54 are French-type doors that collectively span the entire lateral distance of the entrance to the fresh food compartment 52 to enclose the fresh food compartment 52. A center flip mullion 58 (FIG. 2) is pivotally coupled to at least one of the doors 54 to establish a surface against which a seal provided to the other one of the doors 54 can seal the entrance to the fresh food compartment 52 at a location between opposing side surfaces 56 (FIG. 2) of the doors 54. The mullion 58 can be pivotally coupled to the door 54 to pivot between a first orientation that is substantially parallel to a planar surface of the door 54 when the door 54 is closed, and a different orientation when the door 54 is opened. The externally-exposed surface of the center mullion 58 is substantially parallel to the door 54 when the center mullion 58 is in the first orientation, and forms an angle other than parallel relative to the door 54 when the center mullion 58 is in the second orientation. In the embodiment shown in FIG. 1, the seal and the externally-exposed surface of the mullion 58 cooperate at a position offset from a centerline midway between the lateral sides of the fresh food compartment 52. It is contemplate that the seal and the externally-exposed surface of the mullion 58 can cooperate approximately midway between the lateral sides of the fresh food compartment 52.

A dispenser 62 (FIG. 1) for dispensing at least ice pieces, and optionally water, can be provided on an exterior of one of the doors 54 that restricts access to the fresh food compartment 52. The dispenser 62 includes a lever, switch, proximity sensor or other device that a user can interact with to cause frozen ice pieces to be dispensed from an ice bin (not shown) of an ice maker 64 disposed within the fresh food compartment 52. Ice pieces from the ice maker 64 can exit the ice maker 64 through an aperture (not shown) and be delivered to the dispenser 62 via an ice chute (not shown), which extends at least partially through the door 54 between the dispenser 62 and the ice maker 64.

Refrigerator Liner 72

Figure 2:
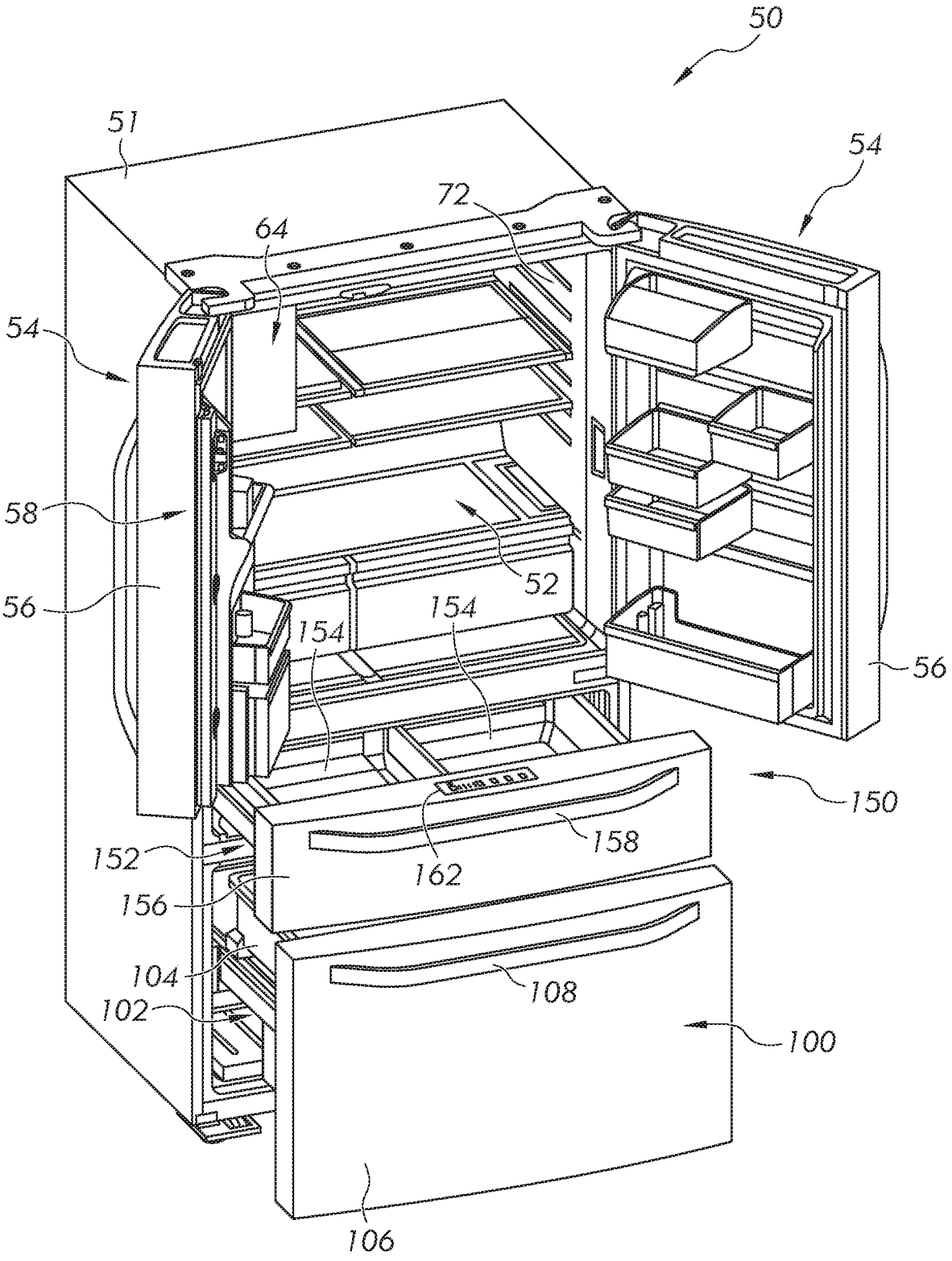
FIG. 2 is a front perspective view of the refrigerator of FIG. 1 showing the doors of the fresh food compartment and the drawers of the freezer compartment and the variable climate zone compartment in an opened position.
Figure 3A:
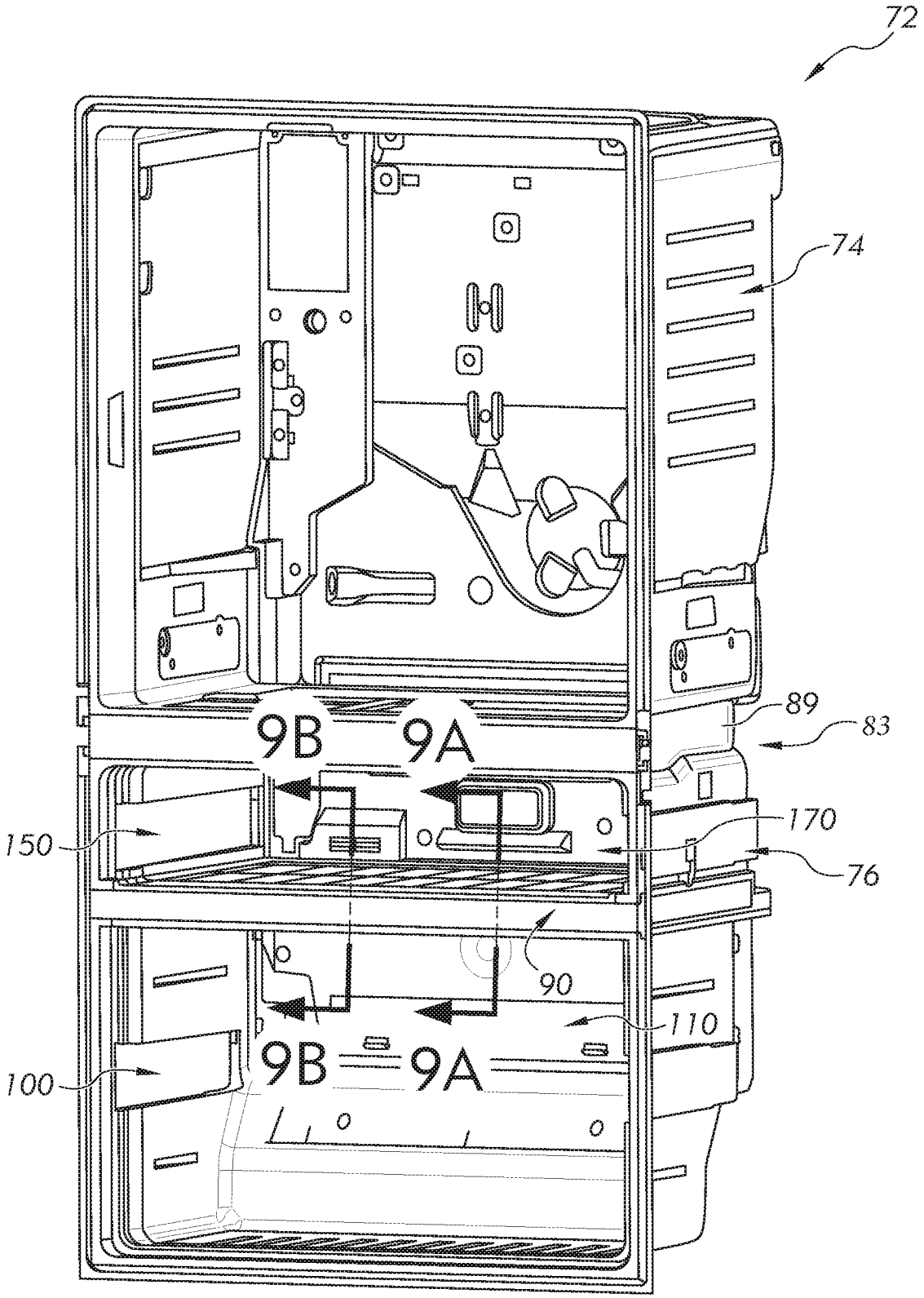
FIG. 3A is a front perspective view showing a liner of the refrigerator of FIG. 1 for the fresh food compartment, the freezer compartment and the variable climate zone compartment and a portion of a foamed insulation between an upper compartment and a lower compartment of the liner.

Referring to FIGS. 2 and 3A, the refrigerator 50 includes an interior liner 72 formed to define an upper compartment 74 and a lower compartment 76. The interior liner 72 is contained within an outer metal shell that defines the exterior of the refrigerator 50. It is contemplated that a space 83 between the upper compartment 74 and the lower compartment 76 may be filled with an expanding blown foam material 89. The foam material 89 is configured to aid in thermally isolating the upper compartment 74 and the lower compartment 76, and further cures to a rigid form that aids in structurally supporting the various compartments of the refrigerator.

The upper compartment 74 defines the fresh food compartment 52 which serves to minimize spoiling of articles of food stored therein. The fresh food compartment 52 accomplishes this by maintaining the temperature in the fresh food compartment 52 at a cool temperature that is typically above 0° C., so as not to freeze the articles of food in the fresh food compartment 52. It is contemplated that the cool temperature is a user-selectable target fresh food temperature, preferably between 0° C. and 10° C., more preferably between 0° C. and 5° C. and even more preferably between 0.25° C. and 4.5° C. A fresh food evaporator (not shown) is dedicated to separately maintaining the temperature within the fresh food compartment 52 independent of the freezer compartment 100. According to an embodiment, the temperature in the fresh food compartment 52 can be maintained at a cool temperature within a close tolerance of a range between 0° C. and 4.5° C., including any subranges and any individual temperatures falling with that range. For example, other embodiments can optionally maintain the cool temperature within the fresh food compartment 52 within a reasonably close tolerance of a temperature between 0.25° C. and 4° C.

The upper compartment 74 and the lower compartment 76 of the liner 72 are configured such that the air circulated in the upper compartment 74 is maintained separated from the air circulated in the lower compartment 76. The lower compartment 76 defines the freezer compartment 100 and the VCZ compartment 150. In this respect, the air circulated in the fresh food compartment 52 is maintained separated from the air circulated in the VCZ compartment 150 and the freezer compartment 100.

Figure 3B:
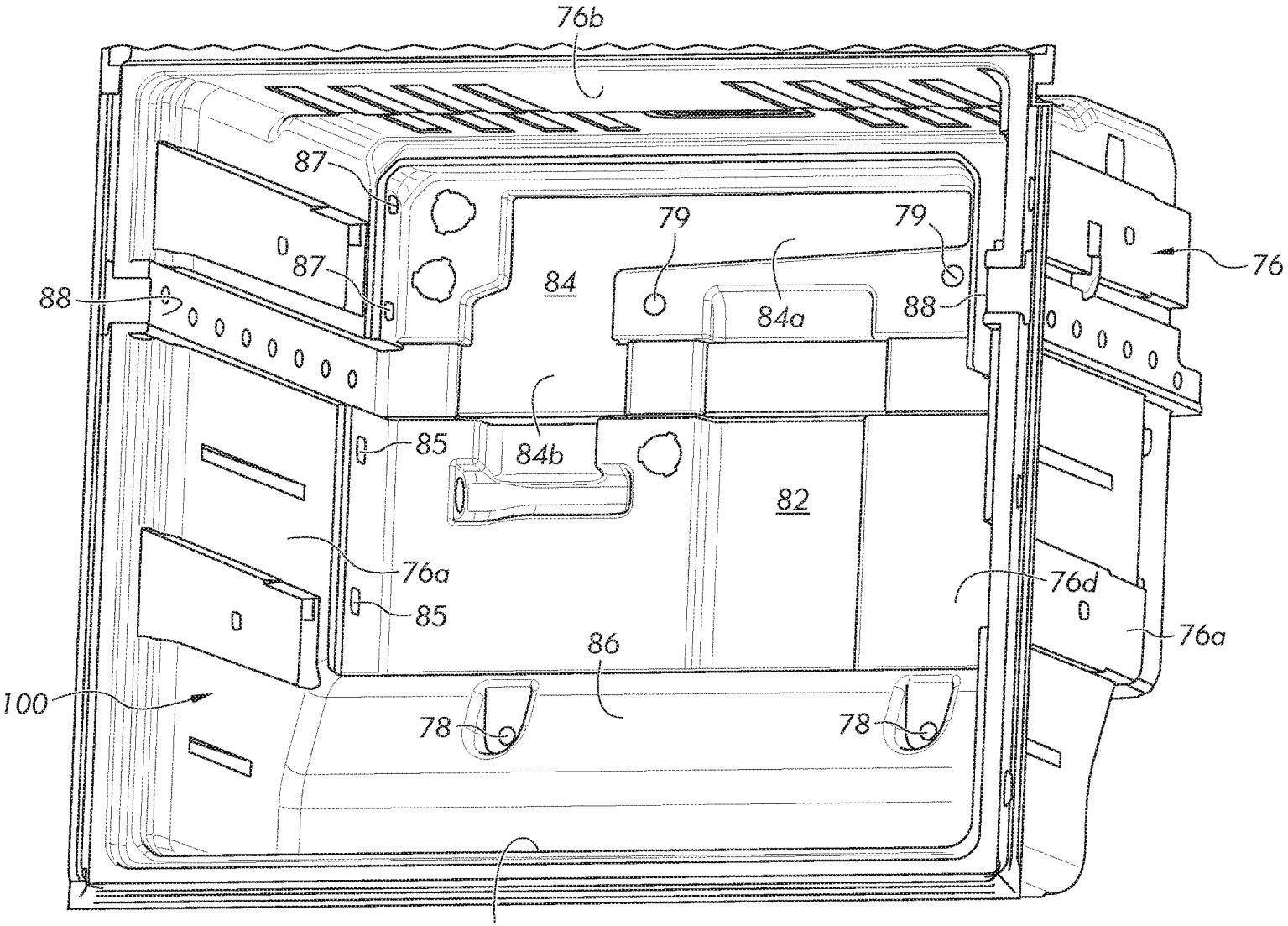
FIG. 3B is a front perspective view showing the lower compartment of the liner of FIG. 3A.

Referring to FIG. 3B, the lower compartment 76 includes side walls 76*a*, a top wall 76*b*, a bottom wall 76*c* and a rear wall 76*d*. A plurality of lower recesses 85 is formed in a lower portion of the side walls 76*a* near the rear wall 76*d* and a plurality of upper recesses 87 is formed in an upper portion of the side walls 76*a* side walls near the rear wall 76*d*. The plurality of upper recesses 85 and the plurality of lower recesses 87 are positioned and dimensioned as described in detail below. The rear wall 76*d* is contoured to define a first recess 82 and a second recess 84. The first recess 82 is shown to be generally rectangular-in-shape and extending in a vertical direction. The second recess 84 is shown to be generally L-shaped with a generally horizontal portion 84*a* and a generally vertical portion 84*b*. The bottom wall 76*c* includes a generally sloped portion 86. A plurality of upper mounting holes 79 extend through the rear wall 76*d* below generally horizontal portion 84*a*. The plurality of upper mounting holes 79 are positioned and dimensioned as described in detail below. A plurality of lower mounting holes 78 extend through an upper portion of the sloped portion 86. The plurality of lower mounting holes 78 are dimensioned and positioned as described in detail below. A horizontal recess 88 is formed in the side walls 76*a* for receiving a partition 90.

Partition 90

Figure 4A:
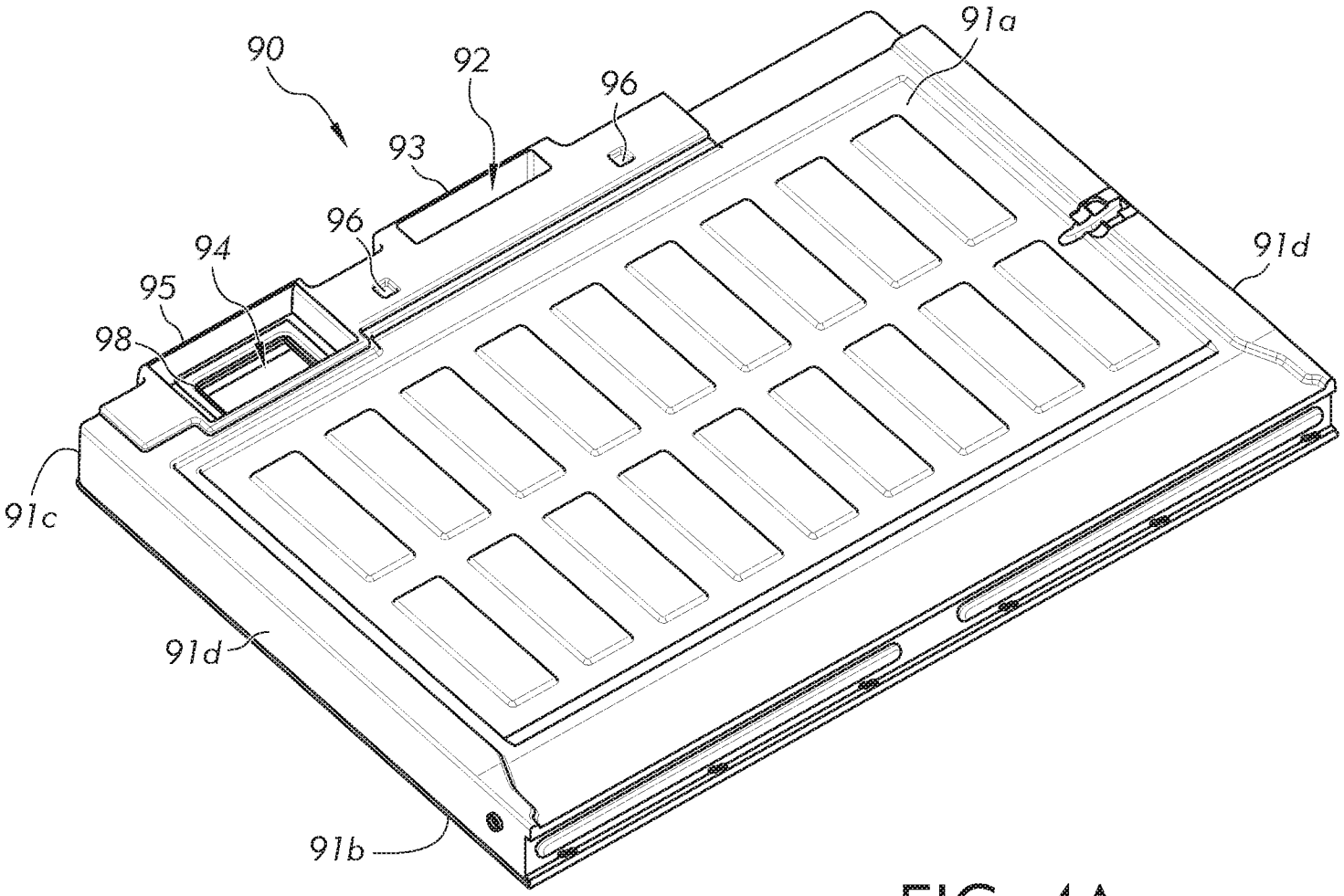
FIG. 4A is a top perspective view of a partition for dividing the freezer compartment from the variable climate zone compartment of FIG. 3A.

Referring to FIG. 3A, the partition 90 is disposed in the lower compartment 76 for separating the lower compartment 76 into the freezer compartment 100 and the VCZ compartment 150. Referring to FIG. 4A, the partition 90 includes a first opening 92 and a second opening 94 extending between an upper surface 91*a* and a lower surface 91*b* of the partition. The openings 92, 94 allow fluid to flow through the partition 90 and establish fluid communication between the freezer compartment 100 and the VCZ compartment 150. The first opening 92 and the second opening 94 are shown as elongated rectangular openings. It is contemplated that the first opening 92 and the second opening 94 may have other shapes, e.g., circular, oval, square, etc. A seat 98 may be formed in the second opening 94. As shown, the seat 98 extends inwardly about a periphery of the second opening 94. It is contemplated that the seat 98 may be a continuous ledge that extends about the second opening 94, a plurality of segmented ledges or discrete ledges at one or more corners or sides of the second opening 94. The seat 98 is dimensioned and positioned as described in detail below.

The partition 90 includes a rear wall 91*c* and a side walls 91*d*. The rear wall 91*c* is contoured to match the contour of the rear wall 76*d* of the lower compartment 76. As shown, the rear wall 91*c* of the partition 90 includes a first protrusion 93 and a second protrusion 95. The first opening 92 aligns with the first protrusion 93 and the second opening 94 aligns with the second protrusion 95. It is contemplated that the first opening 92 may at least partially extend through the first protrusion 93 and the second opening 94 may at least partially extend through the second protrusion 95. The first protrusion 93 and the second protrusion 95 are dimensioned and positioned as described in detail below. A plurality of recess 96 is formed in the upper surface 91*a* of the partition 90 near the rear wall 91*c*. As shown, one recess 96 is disposed to one side of the first opening 92 and another recess 96 is disposed to an opposite side of the first opening 92.

It is contemplated that the partition 90 may be a "not foamed" element. The term "not foamed" is used herein to mean that the partition 90 may not be permanently attached to the liner 72. Conventional partition walls or mullion walls in refrigerators are foamed insulations that cannot be removed, i.e., the partition wall or the mullion wall is a permanent structural wall of the refrigerator. It is contemplated that the partition 90 may be a "not foamed" element and may be removed from the refrigerator, if desired, so that the freezer compartment 100 occupies the entire lower compartment 76. However, it is to be appreciated that the interior of the partition 90 may still include an insulating material of various types, including an insulating foam material, so as to help maintain the desired temperatures of the freezer compartment 100 and the VCZ compartment 150.

Figure 4B:
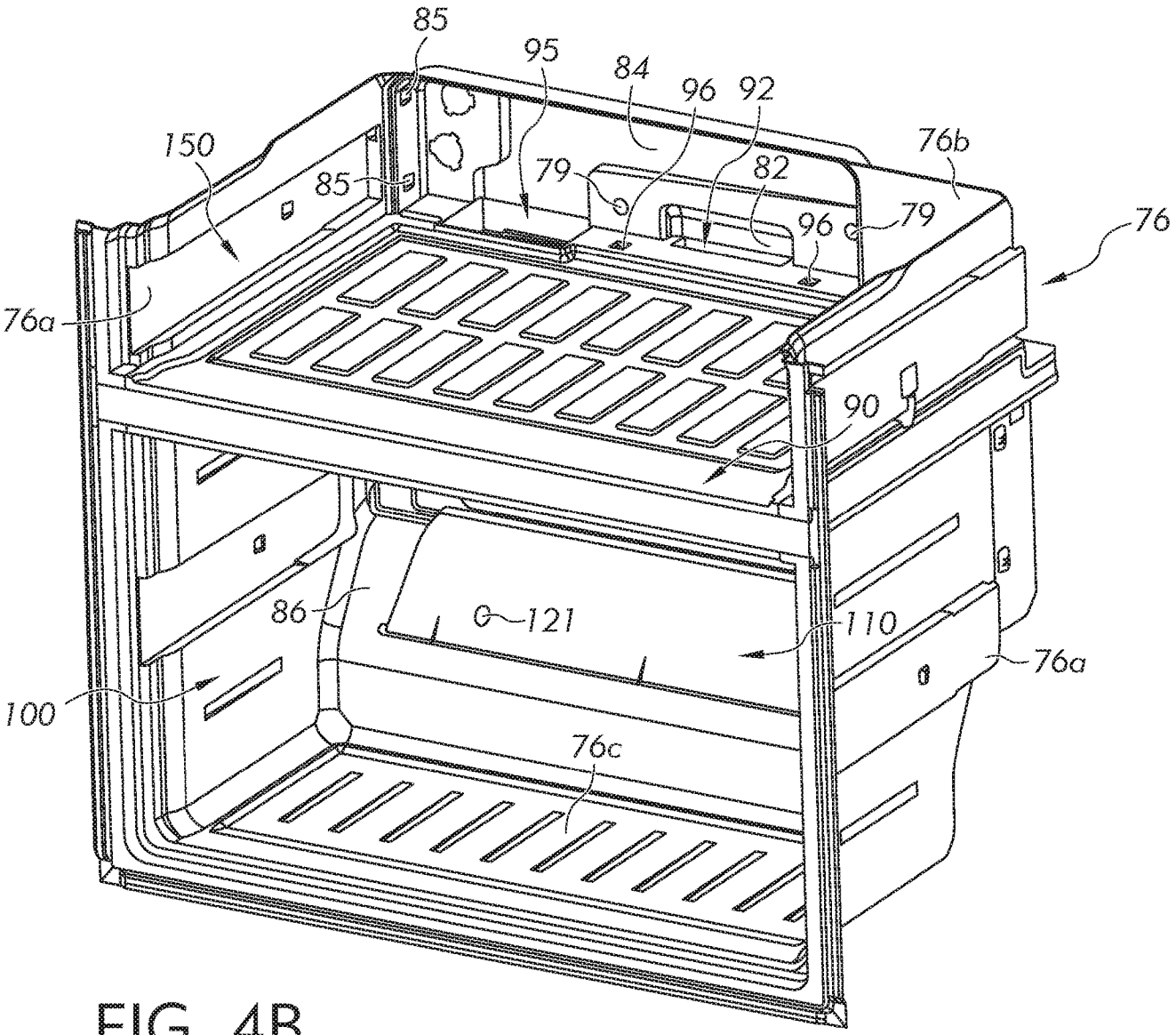
FIG. 4B is a front perspective view of the lower compartment of FIG. 3A with a top wall of the lower compartment removed showing the partition of FIG. 4A in an installed position and a freezer control module disposed below the partition.

Referring to FIG. 4B, the partition 90 is dimensioned to be received in the lower compartment 76. In FIG. 4B, the partition 90 is shown fully inserted into the lower compartment 76. The partition 90 is positioned in the lower compartment 76 such that the first protrusion 93 of the partition 90 (with the first opening 92) is received into the first recess 82 in the rear wall 76*d* of the lower compartment 76, and the second protrusion 95 of the partition 90 (with the second opening 94) is received into the second recess 84 in the rear wall 76*d*. Optionally, a seal member (not shown) may be disposed between the rear wall 91*c* and the rear wall 76*d* for defining a seal between the partition 90 and the rear wall 76*d* of the lower compartment 76. The side walls 91*d* (FIG. 4A) of the partition 90 are received into the horizontal recess 88 (FIG. 3B) formed in the side walls 76*a* of the lower compartment 76. Optionally, it is also contemplated that seal members (not shown) may be disposed between the side walls 91*d* of the partition 90 and the side walls 76*a* of the lower compartment 76 for defining a seal between the partition 90 and the side walls 76*a* of the lower compartment 76. Once the partition 90 is fully inserted into the lower compartment 76, fluid communication between the freezer compartment 100 and the VCZ compartment 150 may be established through the first opening 92 and the second opening 94.

Freezer Compartment 100

Referring to FIG. 2, the freezer compartment 100 is arranged vertically beneath the VCZ compartment 150. A drawer assembly 102 including one or more freezer baskets 104 can be withdrawn from the freezer compartment 100 to grant a user access to food items stored in the freezer compartment 100. The drawer assembly 102 can be coupled to a freezer door 106 that includes a handle 108. When a user grasps the handle 108 and pulls the freezer door 106 open, at least one or more of the freezer baskets 104 is caused to be at least partially withdrawn from the freezer compartment 100.

The freezer compartment 100 is used to freeze and/or maintain articles of food stored in the freezer compartment 100 in a frozen condition. For this purpose, the freezer compartment 100 includes a freezer cooling module 110 (FIGS. 5A-5C), described in detail below, that removes thermal energy from the freezer compartment 100 to maintain the temperature therein at a user-selectable target freezer temperature, e.g., a temperature of 0° C. or less during operation of the refrigerator 50, preferably between 0° C. and −50° C., more preferably between 0° C. and −30° C. and even more preferably between 0° C. and −20° C. The freezer compartment 100 is also in communication with the VCZ compartment 150 such that a portion of the cooling air supplied by the freezer cooling module 110 may be selectively supplied to the VCZ compartment 150.

Freezer Cooling Module 110

Figure 5A:
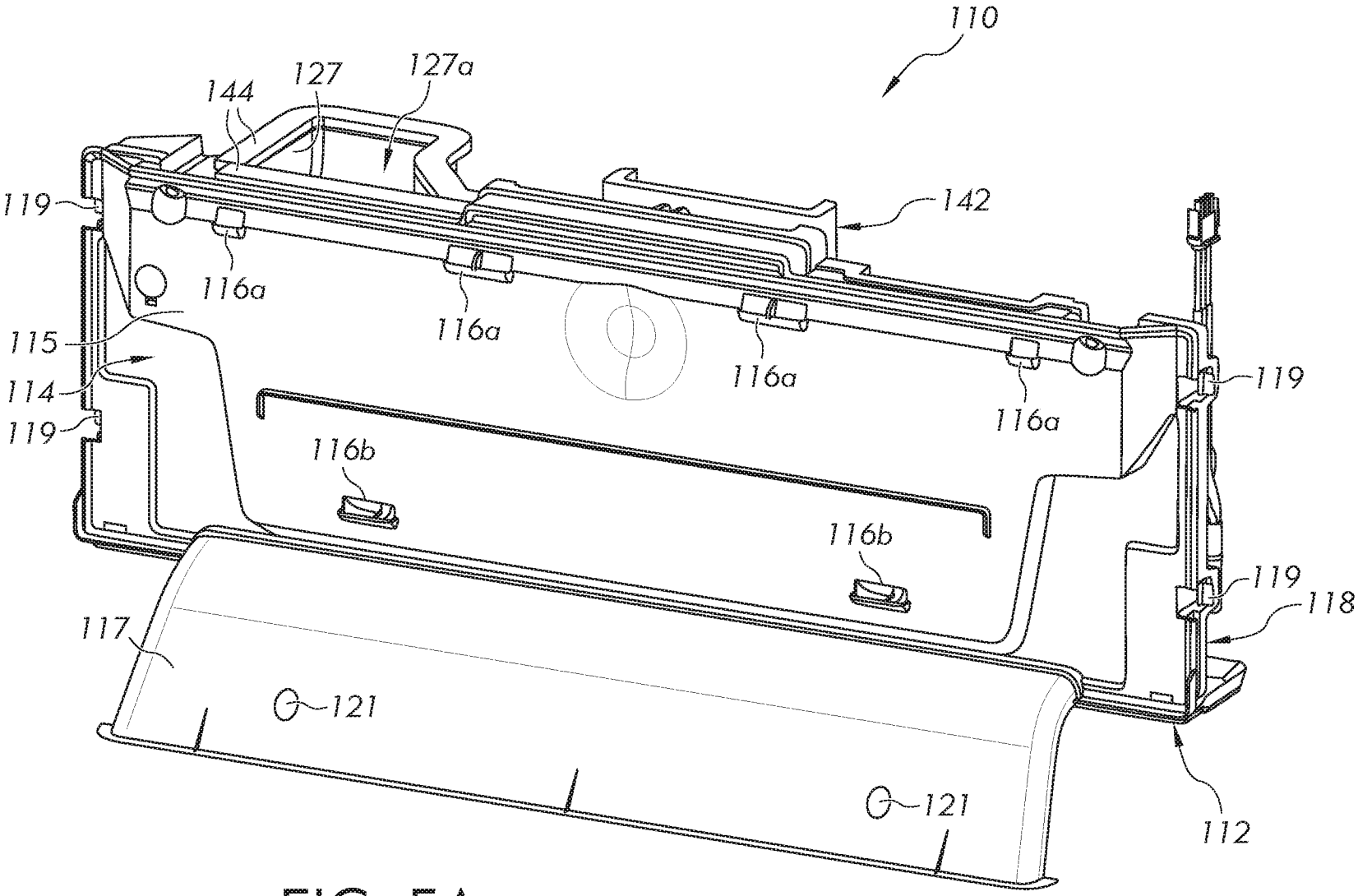
FIG. 5A is a front perspective view of the freezer control module of FIG. 4B.
Figure 5B:
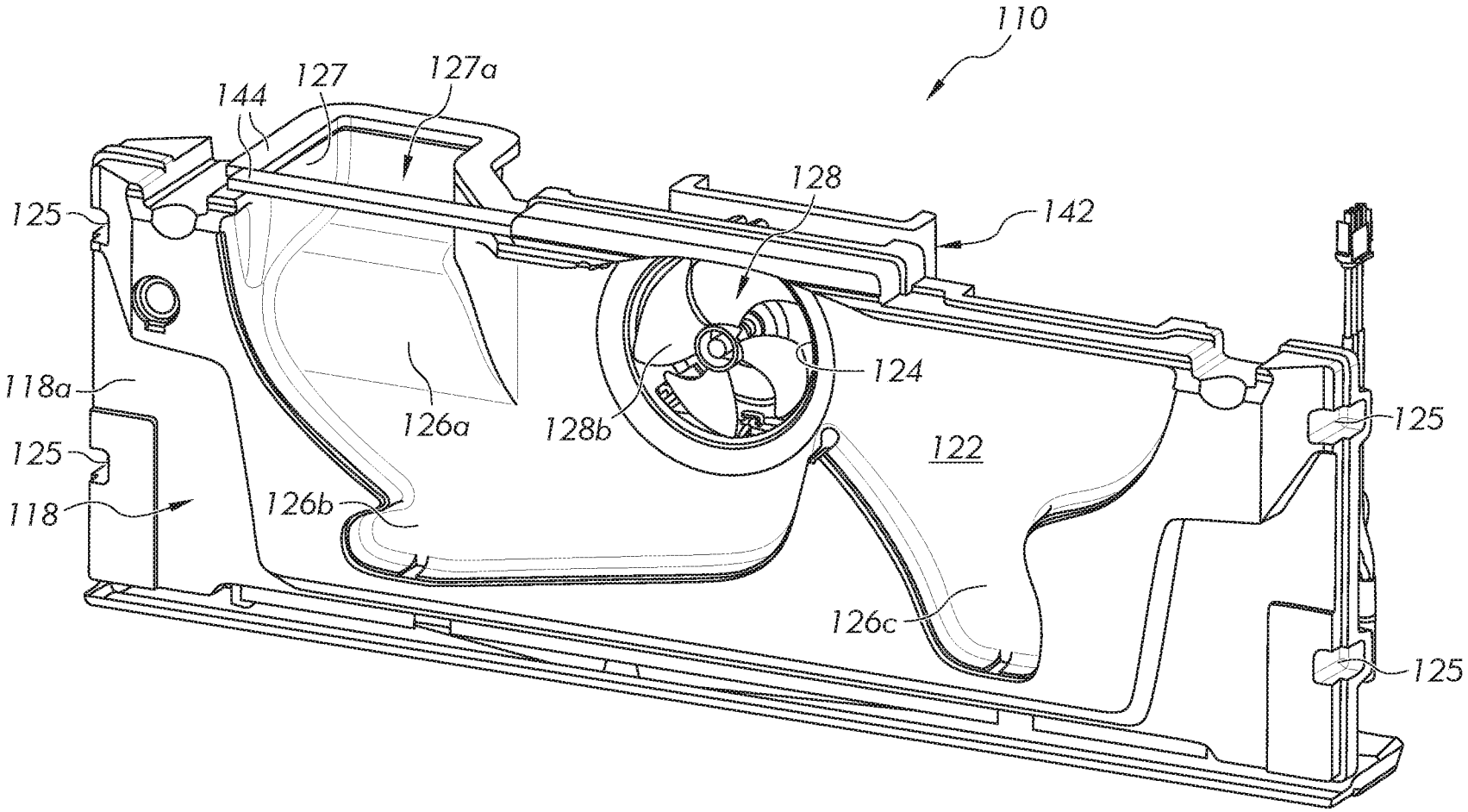
FIG. 5B is a front perspective view of the freezer control module of FIG. 5A with a cover of the module removed.
Figures 5C, 5D:
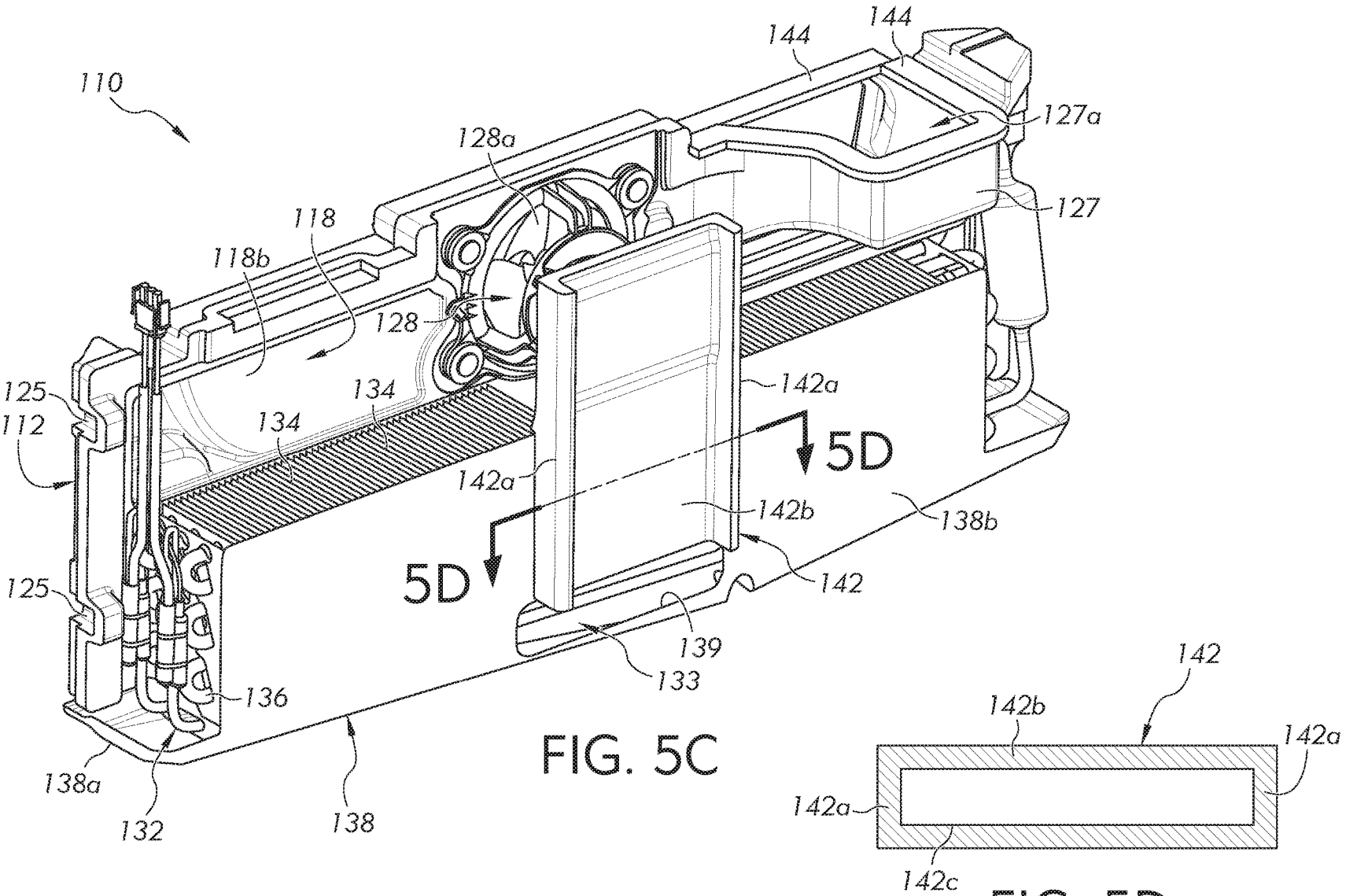
FIG. 5C is a rear perspective view of the freezer control module of FIG. 5A.
FIG. 5D is a section view taken along lines 5D-5D of FIG. 5C showing an alternative configuration of a return duct from the freezer control module.

Referring to FIGS. 5A-5C, the freezer cooling module 110 is shown removed from the freezer compartment 100. In general, the freezer cooling module 110 includes a housing assembly 112, a freezer fan 128 (FIGS. 5B and 5C), an evaporator 132 (FIG. 5C), and a return duct 142.

Referring to FIG. 5A, the housing assembly 112 includes a cover 114 and a body 118. The cover 114 includes a front portion 115 and a flange 117. The front portion 115 is contoured and dimensioned to have various features that are aesthetically pleasing to a consumer. A plurality of openings 116*a*, 116*b* extend through the front portion 115. The openings 116*a* are spaced apart near an upper edge of the front portion 115 and the openings 116*b* are spaced apart near a lower edge of the front portion 115. The openings 116*a*, 116*b* define air outlets of the freezer cooling module 110, as described in detail below. A plurality of tabs 119 extends from the outer edge of the cover 114. The plurality of tabs 119 is positioned and dimensioned and positioned as described in detail below. The flange 117 extends from a lower front portion of the cover 114 at a location below the openings 116*b*. As shown, the flange 117 is a curved elongated element that is dimensioned and positioned as described in detail below. Mounting holes 121 extend through the flange 117. The mounting holes 121 are positioned and dimensioned as described in detail below.

Referring to FIG. 5B, the cover 114 of the housing assembly 112 is removed for clarity. A front surface 118*a* of the body 118 is contoured to form a recessed cavity 122. The recessed cavity 122 is formed around an opening 124 that extends through the body 118 and includes branches 126*a*, 126*b*, 126*c*. One branch 126*a* of the recessed cavity 122 extends to an upper edge of the body 118. The body 118 is contoured to define a chute 127 that extends from a rear surface 118*b* of the body 118. The chute 127 may be rectangular in shape and includes an opening 127*a* that communicates with the branch 126*a* of the recessed cavity 122. The opening 127*a* is formed along the upper edge of the body 118. The opening 127*a* is shown to be generally rectangular in shape. It is contemplated that the opening 127*a* may have other shapes. The branches 126*b*, 126*c* extend toward a lower portion of the body 118 and are positioned and dimensioned as described in detail below. A plurality of recesses 125 is positioned around the outer edge of the body 118. The plurality of recesses 125 is dimensioned and positioned to align with and receive the plurality of tabs 119 on the cover 114 when the cover 114 is attached to the body 118. It is contemplated that the plurality of tabs 119 may engage the plurality of recesses 125 in a snap-fit fashion.

The cover 114 is attached to the body 118 to close the recessed cavity 122 and thereby define in internal passage of the freezer cooling module 110. It is contemplate that the cover 114 may be attached to the body 118 using elements such as, but not limited to, fasteners, adhesives, snap-fit features and combinations of the foregoing. As shown, the recessed cavity 122 is formed in the body 118 and the cover 114 closes an open side of the recessed cavity 122. It is also contemplated that a second recess (not shown) may be formed in the cover 114 such that the internal passage of the freezer cooling module 110 is formed in both the cover 114 and the body 118. It is also contemplated that the cover 114 and the body 118 may be replaced with a single monolithic body (e.g., a single molded component) and the internal passage may be formed, e.g., molded or machined into the single monolithic body.

The freezer fan 128 is positioned within the opening 124 formed in the body 118. The freezer fan 128 is shown as an axial fan wherein air is drawn in from a rear 128*a* (FIG. 5C) of the freezer fan 128 and exhausted out a front 128*b* (FIG. 5B) of the freezer fan 128. Various other types of fans may also be used.

Referring to FIG. 5C, which shows a rear view of the freezer cooling module 110, the freezer evaporator 132 is positioned adjacent the rear surface 118*b* of the body 118. The evaporator 132 includes a plurality of fins 134 and a cooling coil 136 for drawing heat from air conveyed through the evaporator 132 when a refrigerant is circulated through the cooling coils 136. The freezer evaporator 132 is attached to a frame member 138.

The frame member 138 includes a lower horizontal portion 138*a* that extends under the freezer evaporator 132 and a vertical portion 138*b* that extends along a rear side of the freezer evaporator 132. An opening 139 extends through a lower portion of the frame member 138. The opening 139 is shown as an elongated rectangular opening. However, it is contemplated that the opening 139 can have other shapes, for example but not limited to, square, circular, etc. The freezer evaporator 132 is positioned relative to the frame member 138 to define a space 133 between a top of the horizontal portion 138*a* of the frame member 138 and a bottom of the freezer evaporator 132.

The return duct 142 is attached to the vertical portion 138*b* of the frame member 138 on a side opposite the freezer evaporator 132. As shown, the return duct 142 is generally U-shaped having legs 142*a* and a base 142*b*. A lower end of the return duct 142 is positioned to align with the opening 139 extending through the vertical portion 138*b* of the frame member 138. The legs 142*a* may be closely adjacent to or contact the rear wall 76*d* of the lower compartment 76 of the liner 72 (e.g., about first recess 82) to close the return duct 142.

Referring to FIG. 5D, it is alternatively contemplated that the return duct 142 may include an opposing base 142*c* so that the return duct 142 may have a closed cross section, e.g., an O-shaped cross section.

Figure 6A:
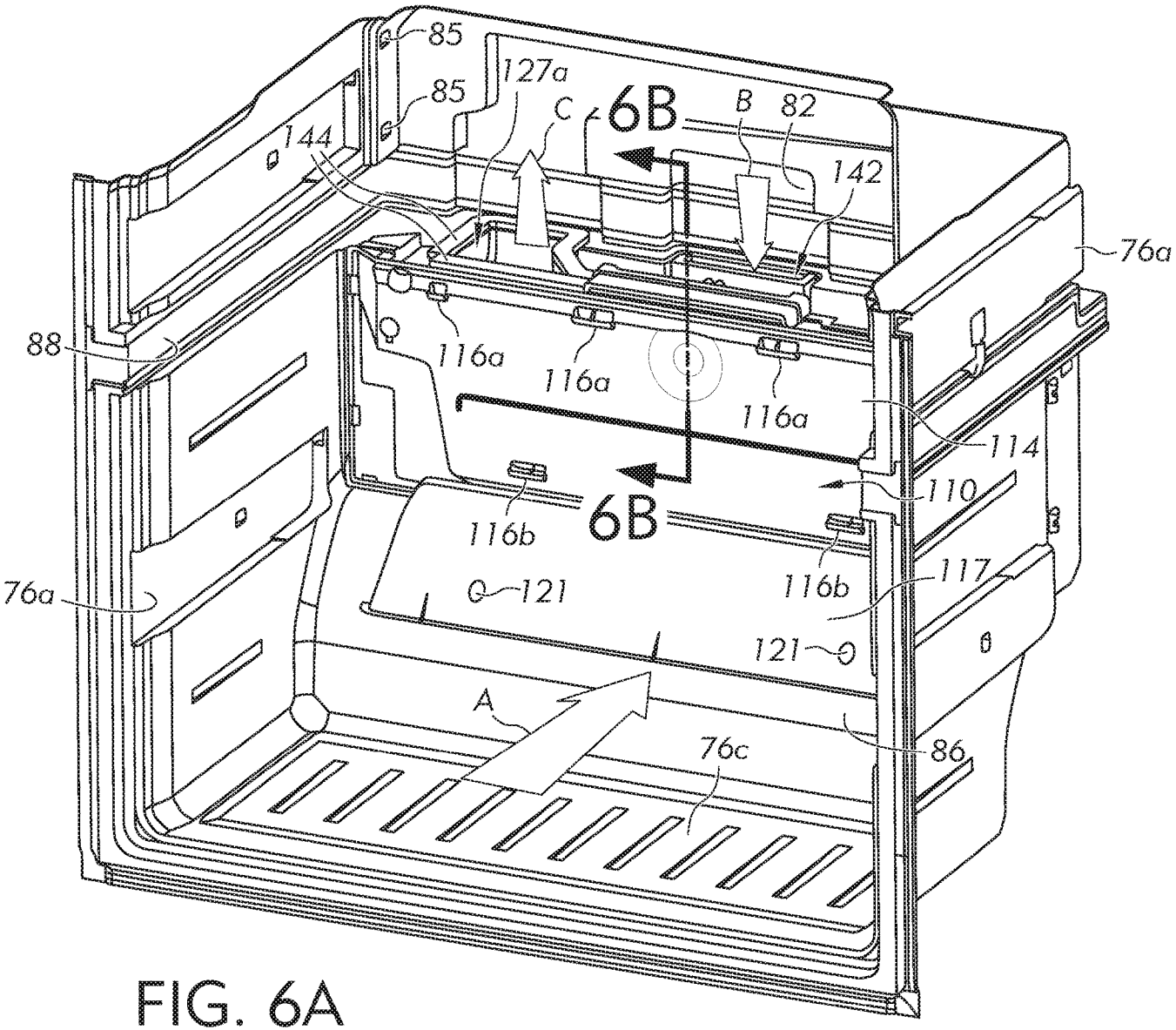
FIG. 6A is a front perspective view of the lower compartment with the top wall of the lower compartment removed and only the freezer control module of FIG. 5A disposed in the lower compartment.
Figure 6B:
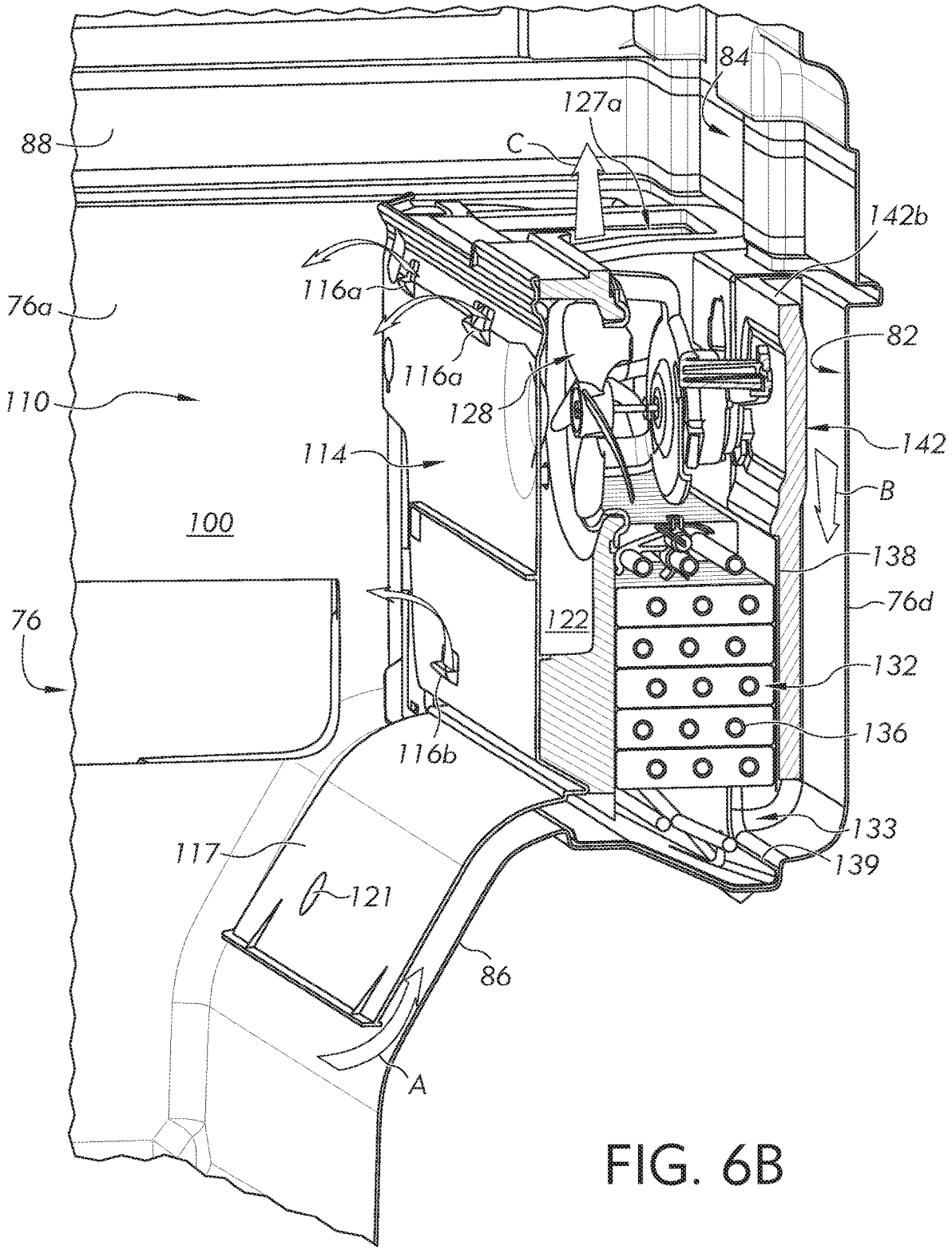
FIG. 6B is a sectioned side view taken along lines 6B-6B of FIG. 6A.

Referring to FIGS. 6A and 6B, the freezer cooling module 110 is positioned within the lower compartment 76 of the liner 72. It is contemplated that the plurality of tabs 119 on the cover 114 of the freezer cooling module 110 (FIG. 5A) and the plurality of lower recesses 85 on the side walls 76*a* of the lower compartment 76 (FIG. 3B) may be positioned and dimensioned to align with each other and engage in a snap-fit fashion. It is contemplated that the plurality of tabs 119 and the plurality of lower recesses 85 may be used to properly position the freezer cooling module 110 into the lower compartment 76 until fasteners (not shown) more rigidly secure the freezer cooling module 110 to the lower compartment 76. The flange 117 of the cover 114 is positioned to be spaced from the sloped portion 86 of the lower compartment 76. The lower mounting holes 78 in the lower compartment 76 and the mounting holes 121 in the flange 117 (FIG. 6B) may be positioned and dimensioned to be in registry with each other so that fasteners (not shown) may extend through the flange 117 and into the rear wall 76*d* of the lower compartment 76 to secure the freezer cooling module 110 to the lower compartment 76. The flange 117 and the sloped portion 86 define a portion of a flow path "A" that extends from a lower portion of the freezer compartment 100 to the space 133 below the evaporator 132. (See FIG. 6B). The return duct 142 is positioned adjacent to the first recess 82 to define a portion of a flow path "B" therebetween. The flow path "B" allows air to flow from an upper portion of the return duct 142 to a lower portion of the return duct 142. Thus, flow paths "A" and "B" allow airflow to return into the freezer cooling module 110. The chute 127 is positioned and dimensioned to at least partially extend into the second recess 84 in the rear wall 76*d* of the lower compartment 76. The opening 127*a* of the chute 127 defines a portion of a flow path "C" for allowing air to exit or be exhausted from the freezer cooling module 110 and into the VCZ compartment 150. Additionally, exits through the openings 116*a*, 116*b* in the cover 114 also allow air to exit or be exhausted from the freezer cooling module 110 into the freezer compartment 100.

Referring to FIGS. 5A-6B, one or more gasket elements 144 may be positioned along an upper edge of the freezer cooling module 110 to define seal between the freezer cooling module 110 and the lower surface 91*b* of the partition. For clarity, the partition 90 is not shown in FIG. 6A.

VCZ Compartment 150

Referring to FIG. 2, the VCZ compartment 150 is positioned in the lower compartment 76 above the partition 90. The VCZ compartment 150 is configured to operate at different user-selectable temperatures as either a refrigerator (i.e., above-freezing) or a freezer (i.e., below-freezing). In general, the VCZ compartment includes a drawer assembly 152 and a temperature control system 170 (FIG. 3A).

The drawer assembly 152 is positioned in the VCZ compartment 150 and includes a basket or tray 154 for storing food items thereon. The drawer assembly 152 can be withdrawn from the VCZ compartment 150 to grant a user access to the food items. The drawer assembly 152 includes a door 156 having a handle 158 attached thereto. When a user grasps the handle 158 and pulls the door 156, the basket or tray 154 is caused to be at least partially withdrawn from the VCZ compartment 150.

A control unit or user interface 162 is disposed on an upper portion of the door 156. The user interface 162 is positioned such that it is not visible when both the drawer assembly 152 of the VCZ compartment 150 and the drawer assembly 102 of the freezer compartment 100 are in the closed position (see FIG. 1). The user interface 162 is accessible when the door 156 of the VCZ compartment 150 is extended from the refrigerator. The user interface 162 is configured to allow a user the ability to selectively operate the VCZ compartment 150 at a user-selectable target variable climate zone temperature between a predetermined temperature below 0 degrees Centigrade and a predetermined temperature above 0 degrees Centigrade including both true fresh food and freezing temperatures, for example, −18° C., −12° C., −2 C, 0° C. and +4° C. It is contemplated that the user interface 162 may be a plurality of push buttons, a touch display screen, a keyboard or any conventional device for allowing a user to input commands to a control system (not shown) of the refrigerator 50.

Temperature Control System 170

Figure 7A:
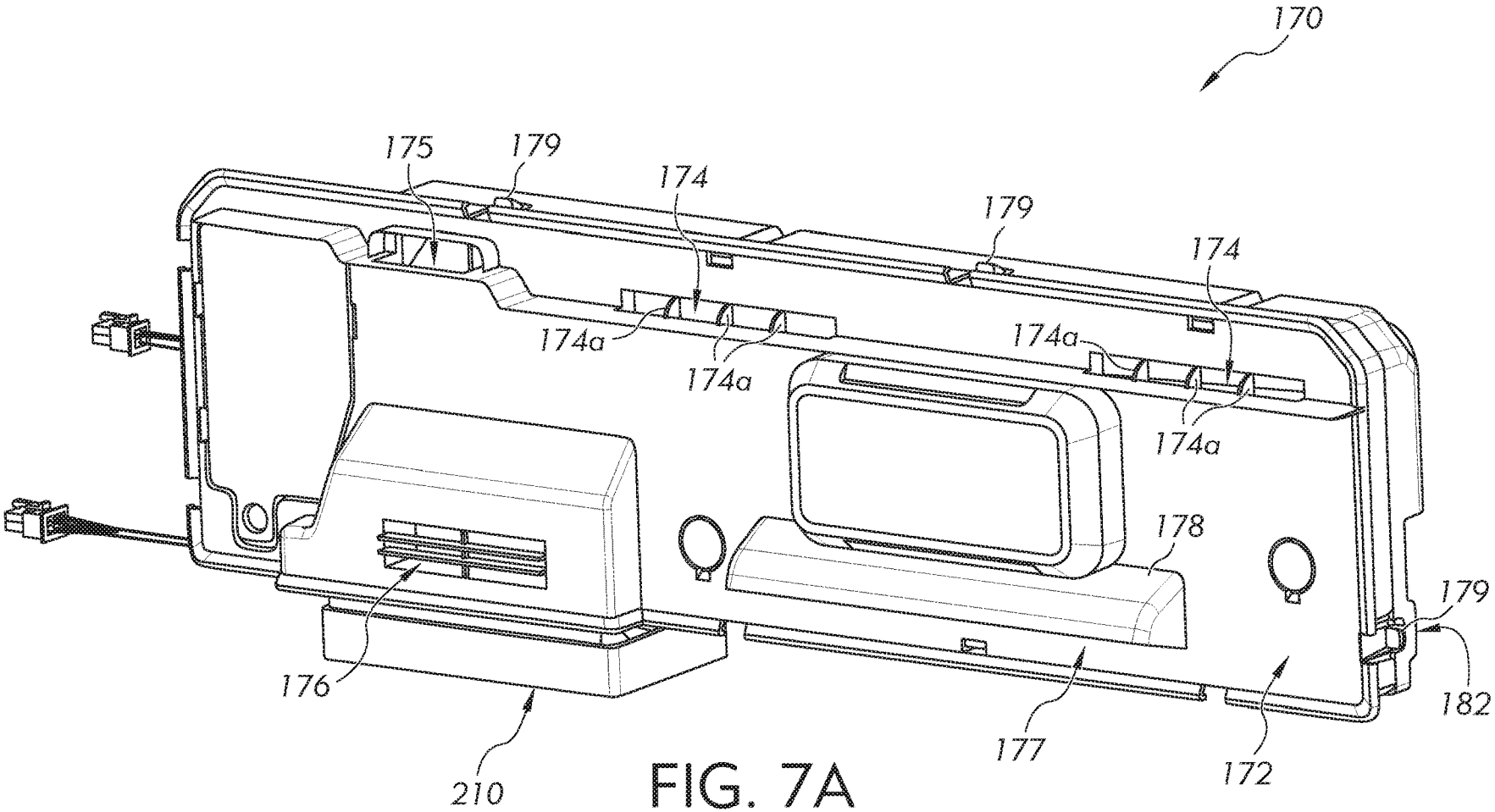
FIG. 7A is a front perspective view of a temperature control system for the variable climate zone compartment of FIG. 3A.
Figure 7B:
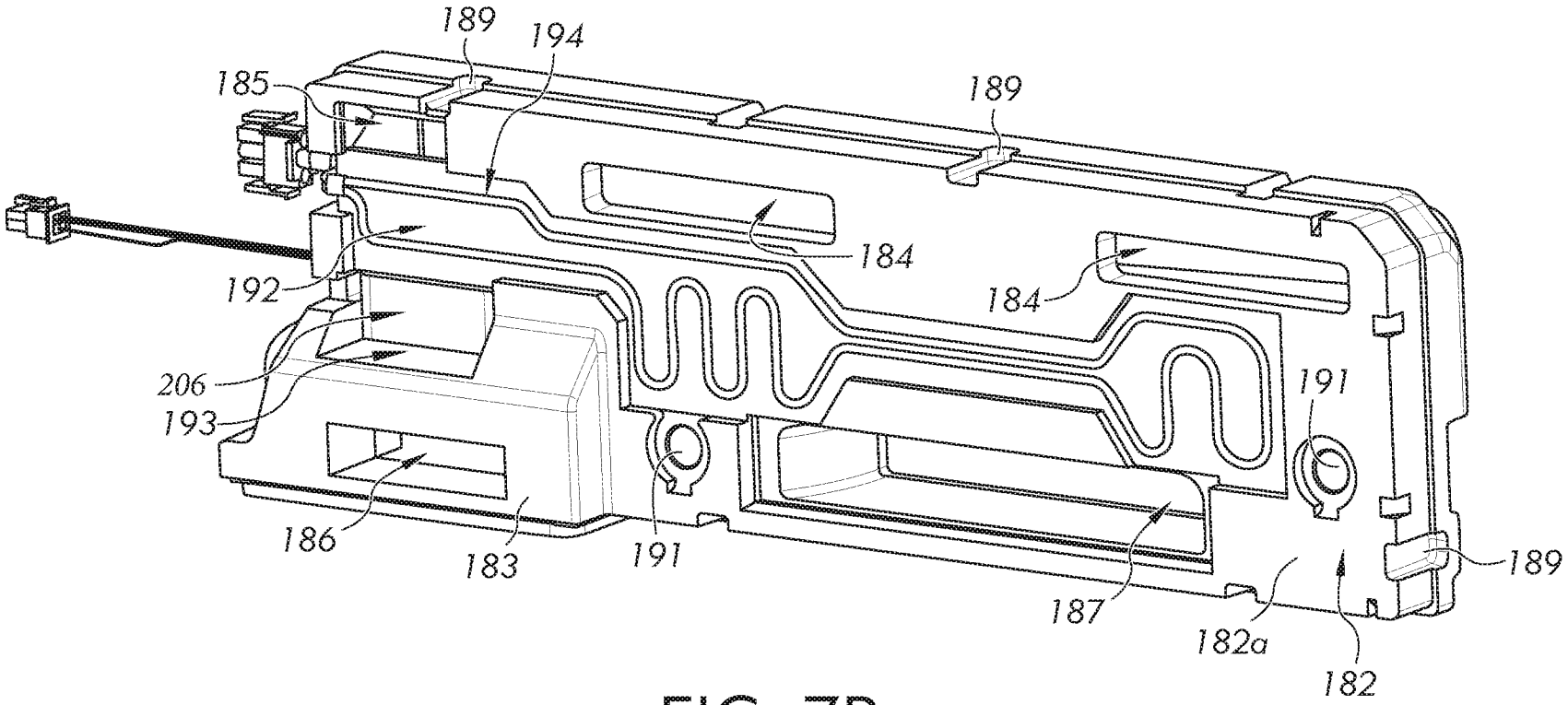
FIG. 7B is a front perspective view of the temperature control system of FIG. 7A with a front cover removed.
Figure 7C:
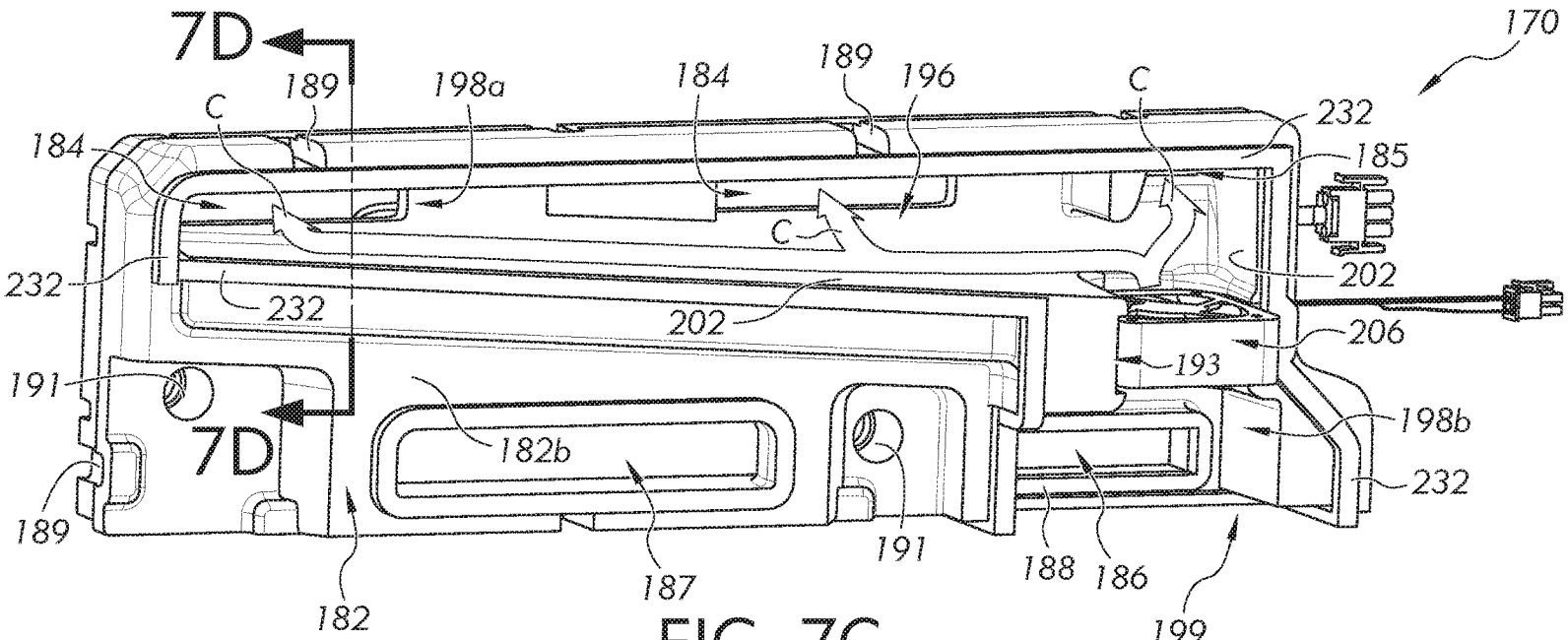
FIG. 7C is a rear perspective view of the temperature control system of FIG. 7B.
Figure 8:
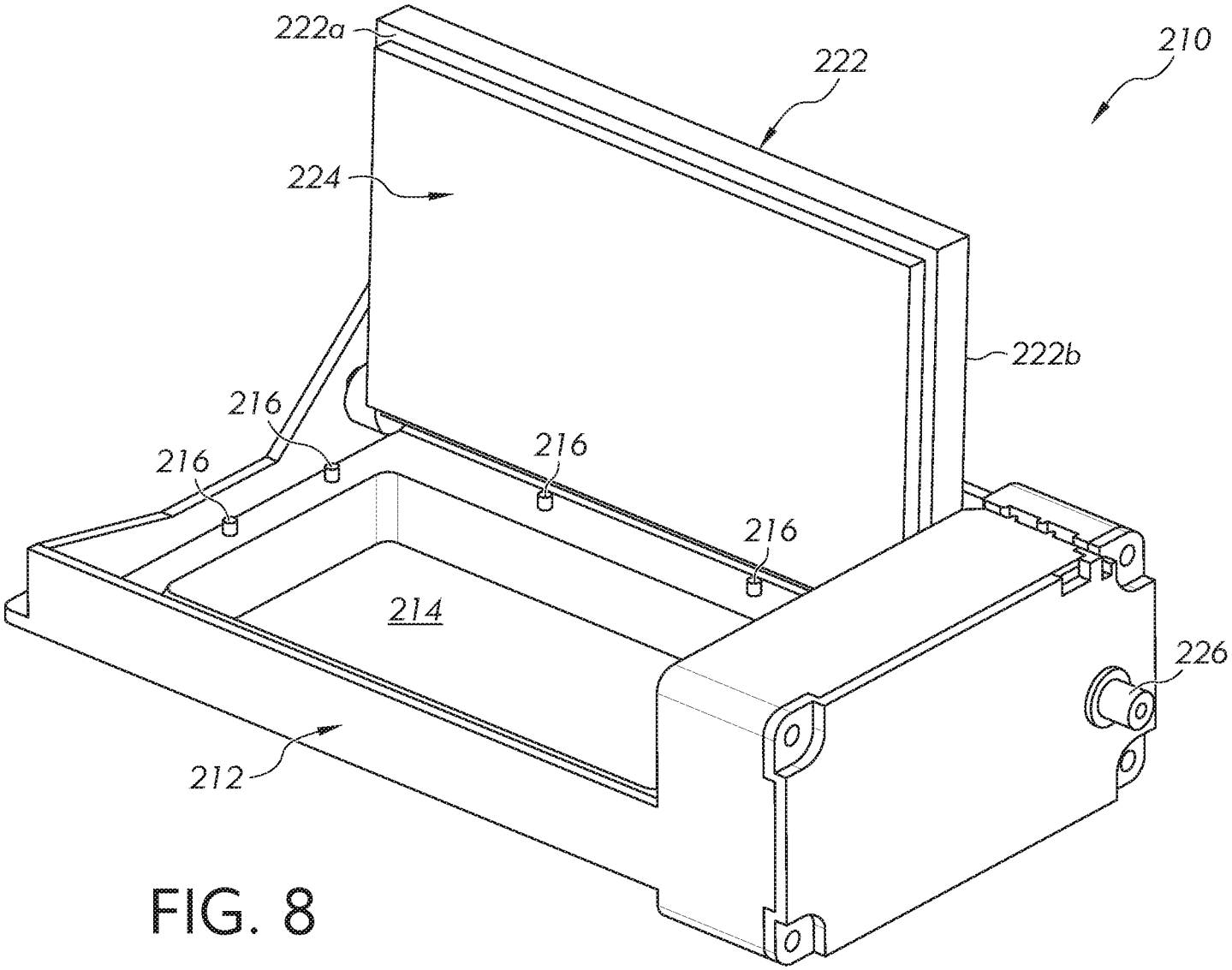
FIG. 8 is a perspective view of a damper assembly for the temperature control system of FIG. 7A showing the damper assembly in an open position.

Referring to FIG. 3A, the temperature control system 170 of the VCZ compartment 150 is positioned above the partition 90. The temperature control system 170 defines a vertical partition that is positioned in a rear portion of the VCZ compartment 150. Referring to FIGS. 7A-7C, in general, the temperature control system 170 includes a cover 172, a body 182, a heater 194, a fan 206 (FIG. 7C), and a damper assembly 210 (FIGS. 7A and 8).

Referring to FIG. 7A, the cover 172 includes a plurality of outlets 174, 175 for exhausting air from the temperature control system 170 into the VCZ compartment 150. In the embodiment shown, the outlets 174, 175 are generally rectangular-in-shape. It is contemplated that the outlets 174, 175 may be other shapes, e.g., oval, circular, square, etc. The outlets 174, 175 define outlets for allowing air to exit or be exhausted from the temperature control system 170, as described in detail below. Optionally, in the embodiment shown, the outlets 174 include flow guide elements 174*a* for directing the air exiting the temperature control system 170 in a predetermined direction into the VCZ compartment 150.

A first inlet 176 and a second inlet 177 extend through the cover 172. In the embodiment shown, the first inlet 176 is a grated opening having a plurality of rectangular openings. It is contemplated that the first inlet 176 may be a single opening or the grated opening may be defined by an insert that is positioned in or over a single opening. In the embodiment shown, the second inlet 177 is a single elongated rectangular opening that is partially covered by a cover element 178. In the embodiment shown, the cover element 178 is an awning-shaped element that extends in a covering relationship along a top and sides of the second inlet 177. It is contemplated that the cover element 178 may have other shapes and/or sizes so long as the cover element 178 helps to hinder objects from falling into the second inlet 177. It is contemplated that the cover 172 may be made of a plastic material, such as, but not limited to polypropylene.

Figure 7E:
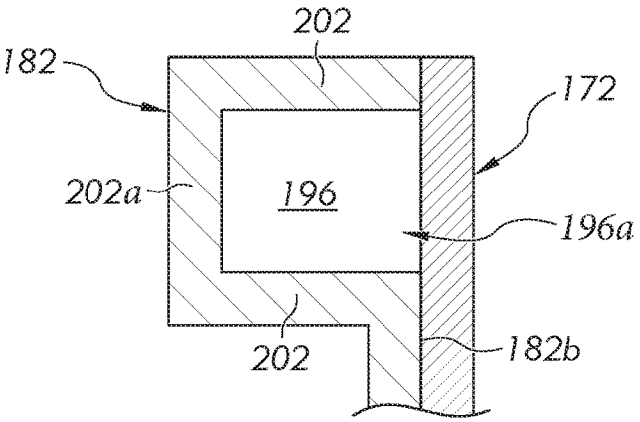
FIG. 7E is a sectioned view taken along lines 7D-7D of FIG. 7C showing a second alternative arrangement for the elongated channel of the temperature control system.
Figure 7D:
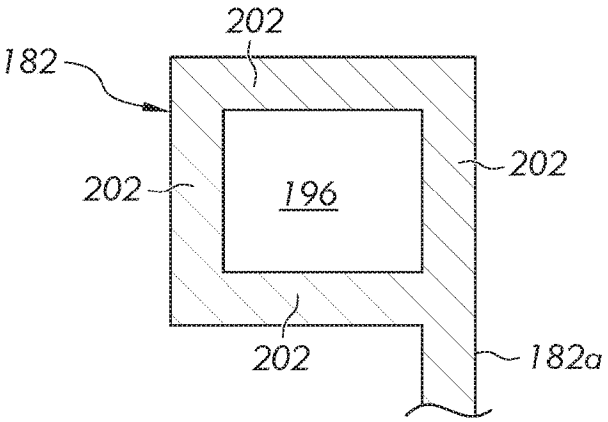
FIG. 7D is a sectioned view taken along lines 7D-7D of FIG. 7C showing an alternative arrangement for an elongated channel of the temperature control system.
Figure 7F:
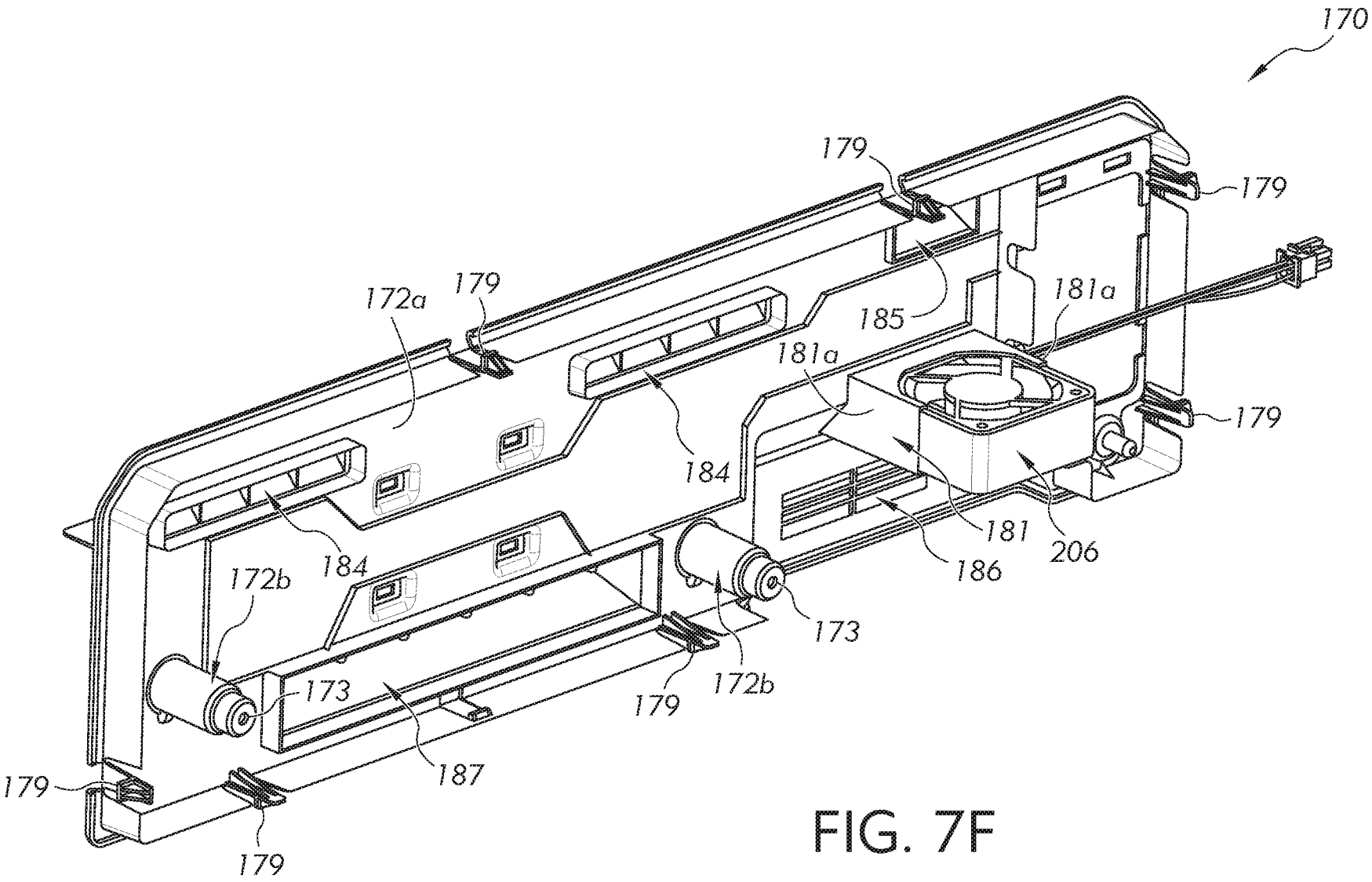
FIG. 7F is a rear perspective view of the front cover of the temperature control system of FIG. 7A.

Referring to FIG. 7F, a rear surface 172*a* of the cover 172 is shown. A plurality of tabs 179 extends from the outer edge of the cover 172. The plurality of tabs 179 is dimensioned and positioned as described in detail below. Two bosses 172*b* extend from the rear surface 172*a*. Mounting holes 173 extend through a lower surface of each boss 172*b*. As shown, the bosses 172*b* are generally cylindrical-in-shape and are positioned on opposite sides of the cover element 178. The bosses 172*b* are dimensioned and positioned as described in detail below. A bracket 181 extends from the rear surface 172*a* of the cover 172. As shown, the bracket 181 is U-shaped with legs 181*a* that are dimensioned as described in detail below.

Referring to FIG. 7B, the cover 172 is removed for clarity so that a front surface 182*a* of the body 182 may be shown. The body 182 includes a plurality of openings 184, 185, 186, 187 that extend through the body 182. Two openings 184 are positioned along an upper portion of the body 182. The opening 185 is positioned to one side of the body 182. Opening 186 is formed in a raised portion 183 that extends from the front surface 182*a* of the body 182. Opening 187 extends along a lower portion of the body 182. The openings 184, 185, 186, 187 are positioned and dimensioned as described in detail below. In the embodiment shown, the openings 184, 185, 186, 187 all are rectangular-in-shape. It is contemplated that the openings 184, 185, 186, 187 may have other shapes such as, but not limited to, circular, oval, square, etc.

An opening 193 extends through the body 182. As shown, the opening 193 is rectangular-in-shape and is positioned above the raise portion 183. The opening 193 is dimensioned and positioned to receive the fan 206, as described in detail below.

A recess 192 is formed in the front surface 182*a* of the body 182. The recess 192 is dimensioned to receive the heater 194. The recess 192 may be, for example, a generally planar surface that is recessed into and offset from the front surface 182*a* of the body 182. However, other recesses having different shapes may also be used, such as a form-fitting recess that corresponds closely to the geometry of the heater 194. In another alternative, the heater 194 may be located directly upon the front surface 182*a* of the body 182 without any recess. The heater 194 is shown as an elongated electric coil heater. It is contemplated that the heater 194 may be other types of conventional heating elements, such as, but not limited to, a strip electric heater, a ceramic heater, a flexible heating element, a thermoelectric heating element, etc. It is contemplated that a thermal tape (not shown) may optionally be used for securing the heater 194 to the body 182 or the cover 172 during a manufacturing process, although the heater 194 could be mounted by way of mechanical fasteners or the like. A plurality of recesses 189 is positioned around the outer edge of the body 182. The plurality of recesses 189 is dimensioned and positioned to align with and receive the plurality of tabs 179 on the cover 172 when the cover 172 is attached to the body 182. It is contemplated that the plurality of tabs 179 may engage the plurality of recesses 189 in a snap-fit fashion. It is contemplated that the plurality of tabs 179 and the plurality of lower recesses 189 may be used to properly position the temperature control system 170 into the lower compartment 76 until fasteners (not shown) more rigidly secure the temperature control system 170 to the lower compartment 76. Holes 191 extend through the body 182. The holes 191 are positioned and dimensioned as described in detail below.

In the embodiment shown, the temperature control system 170 is a shown as including the cover 172, the body 182 and the heater 194 captured therebetween. It is contemplated that the cover 172 and the body 182 may be formed as a single monolithic body (e.g., a single molded component) that is overmolded around the heater 194. Alternatively, the heater 194 may be inserted into a slot formed, e.g., molded or machined into the single monolithic body.

In the embodiment shown, the recess 192 is formed in the front surface 182*a* of the body 182. It is contemplated that the recess 192 may be formed in a rear surface of the cover 172 or in both the front surface 182*a* of the body 182 and the rear surface of the cover 172. It is also contemplated that the heater 194 may be overmolded into the body 182 or the cover 172.

Referring to FIG. 7C, a rear surface 182*b* of the body 182 is contoured to define an elongated channel 196. The elongated channel 196 is dimensioned and positioned to be in registry with the openings 184, 185, 186. In the embodiment shown, the channel 196 is generally L-shaped and includes a horizontal portion 198*a* and a vertical portion 198*b*. The horizontal portion 198*a* is in registry with the openings 184 and 185. The vertical portion 198*b* is in registry with the opening 186. The vertical portion 198*b* defines an open lower end 199 of the elongated channel 196. It is contemplated that the channel 196 may be defined by a plurality of walls 202 that extend from the rear surface 182*b* of the body 182. The wall 202 extending below the horizontal portion 198*a* of the channel 196 may be sloped toward the vertical portion 198*b*. If the horizontal portion 198*a* of the channel 196 is sloped, preferably the horizontal portion 198*a* narrows in width as it extends away from the vertical portion 198*b* to thereby encourage airflow to flow substantially equally from each opening 184, in particular the opening 184 located at the end of the channel 196. It is contemplated that the body 182 may be made of plastic material, such as, but not limited to expanded polystyrene. A plurality of seal elements 232 may be disposed on the distal ends of the plurality of walls 202. The seal elements 232 are positioned as described in detail below to engage the rear wall 76*d* of the lower compartment 76 such that the rear wall 76*d* closes the elongated channel 196.

In the embodiment shown, the elongated channel 196 in the body 182 includes an open longitudinal side, i.e., the elongated channel 196 has a U-shaped cross section. Referring to FIG. 7D, it is contemplated that the elongated channel 196 may be closed on all longitudinal sides by the walls 202 such that the elongated channel 196 has a closed shaped cross section, e.g., an "O" or a "D" shape.

Referring to FIG. 7E, it is contemplated that a side wall 202*a* may close a rear side of the elongated channel 196 and a front opening 196*a* of the elongated channel 196 may face the cover 172. When the cover 172 is attached to the body 182, the cover 172 may close the front opening 196*a* of the elongated channel 196 such that the cover 172 and the body 182 together define an internal air passageway of the temperature control system 170.

A seal element 188 is disposed on the rear surface 182*b* of the body 182. The seal element 188 extends about a periphery of the opening 186.

The fan 206 is positioned within the channel 196 for conveying air along the channel 196. In the embodiment shown the fan 206 is positioned in the vertical portion 198*b* below the opening 185 and above the opening 186. As shown in FIG. 7F, the fan 206 is dimensioned to be received in the bracket 181 on the rear surface 172*a* of the cover 172. It is contemplated that the fan 206 may be secured in the bracket 181 using means such as, but not limited to, interference fits, fasteners and adhesives.

Referring to FIGS. 7A and 7B, the cover 172 is attached to a front surface 182*a* of the body 182. It is contemplate that the cover 172 may be attached to the body 182 using fastening means such as, but not limited to, fasteners, adhesives, snap-fit features and combinations of the foregoing. The outlets 174 of the cover 172 and the openings 184 of the body 182 are positioned and dimensioned to be in registry with each other. The outlet 175 of the cover 172 and the opening 185 of the body 182 are positioned and dimensioned to be in registry with each other. The first inlet 176 of the cover 172 and the opening 186 of the body 182 are positioned and dimensioned to be in registry with each other. The second inlet 177 of the cover 172 and the opening 187 of the body 182 are positioned and dimensioned to be in registry with each other. The bosses 172*b* on the rear surface 172*a* of the cover 172 and the holes 191 on the body 182 are dimensioned and positioned such that the bosses 172*b* extend through the holes 191. The bracket 181 on the rear surface 172*a* of the cover 172 and the opening 193 in the body 182 are dimensioned and positioned such that the bracket 181 and the fan 206 extend through the opening 193 to position the fan 206 in the vertical portion 198*b* of the elongated channel 196. It is contemplated that the fan 206 alternatively may be secured directly to the body 182 using means such as, but not limited to, interference fits, fasteners and adhesives.

Damper Assembly 210

As shown in FIG. 7A, the damper assembly 210 is disposed in the open lower end 199 of the elongated channel 196. Referring to FIG. 8, the damper assembly 210 includes a frame 212 and a damper door 222. The frame 212 includes an opening 214 extending through the frame 212. A plurality of tabs 216 may be positioned around the opening 214. The damper door 222 is attached to the frame 212 to pivot relative to the opening 214. The damper door 222 has a shape that closely matches the shape of the opening 214 for closing the opening.

The damper door 222 may include a seal element 224 on a first side 222*a* of the damper door 222. Preferably, the seal element 224 may be made of an elastic element, e.g., rubber or foam, although a rigid plastic material could also be used. It is contemplated that the seal element 224 may be attached to the first side 222*a* of the damper door 222 using a fastening means, such as, but not limited to adhesives, fasteners, etc. In the embodiment shown, the seal element 224 is a single element that is attached to the first side 222*a* of the damper door 222. It is contemplated that the seal element 224 may be formed by encasing or surrounding the entire damper door 222 such that the seal element covers the first side 222*a* and a second side 222*b* of the damper door 222.

A motor 226 (partially shown in FIG. 8) may be provided for moving the damper door 222. The damper door 222 may be moveable between a first or lower position (FIG. 9C) and a second or upper position (FIG. 8, 9B). When in the lower position the first side 222*a* of the damper door 222 rests on the plurality of tabs 216 and the seal element 224 engages the frame 212 for obstructing the flow of air through the opening 214. In the embodiment shown, the seal element 224 is shown as part of the damper door 222. It is also contemplated that the seal element 224 may be part of the frame 212. When in the upper position, the damper door 222 is positioned as described in detail below.

It is contemplated that the motor 226 may pivot the damper door 222 to a plurality of positions between and including the upper position and the lower position for controlling and adjusting the flow of air to the VCZ compartment 150. It is also contemplated that a heater element (not shown) may be disposed in/on the frame 212 and/or the damper door 222 for heating the frame 212 and/or the damper door 222. The heat applied to the frame 212 and/or the damper door 222 by the heater may be sufficient to prevent the damper door 222 from freezing to the frame 212.

Figure 9A:
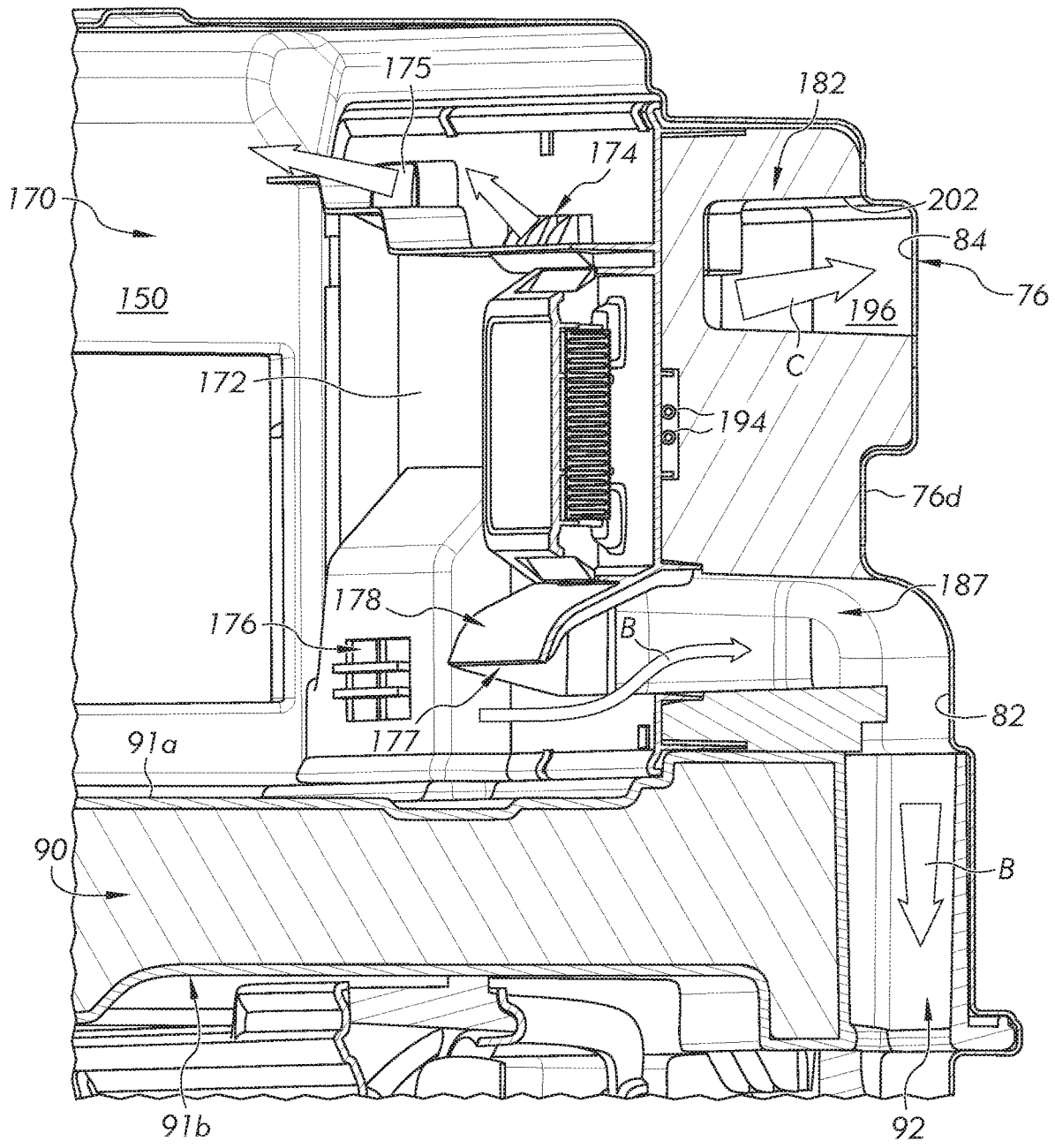
FIG. 9A is a sectioned side view taken along lines 9A-9A of FIG. 3A showing the temperature control system of FIG. 7A disposed in the lower compartment of the liner of FIG. 3A.
Figure 9B:
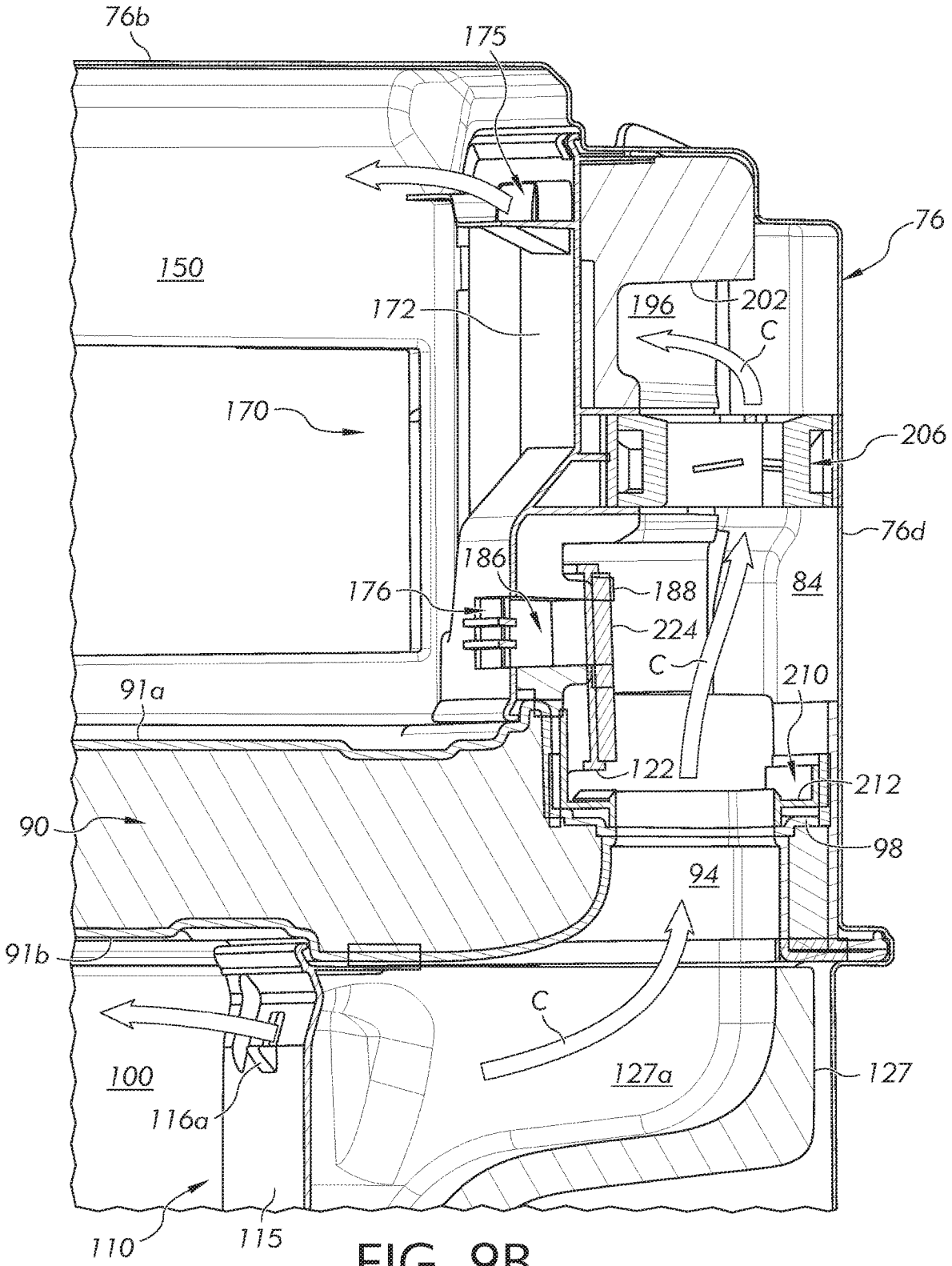
FIG. 9B is a sectioned side view taken along lines 9B-9B of FIG. 3A showing the temperature control system of FIG. 7A disposed in the lower compartment of the liner of FIG. 3A and the damper assembly of FIG. 8 in an open position.
Figure 9C:
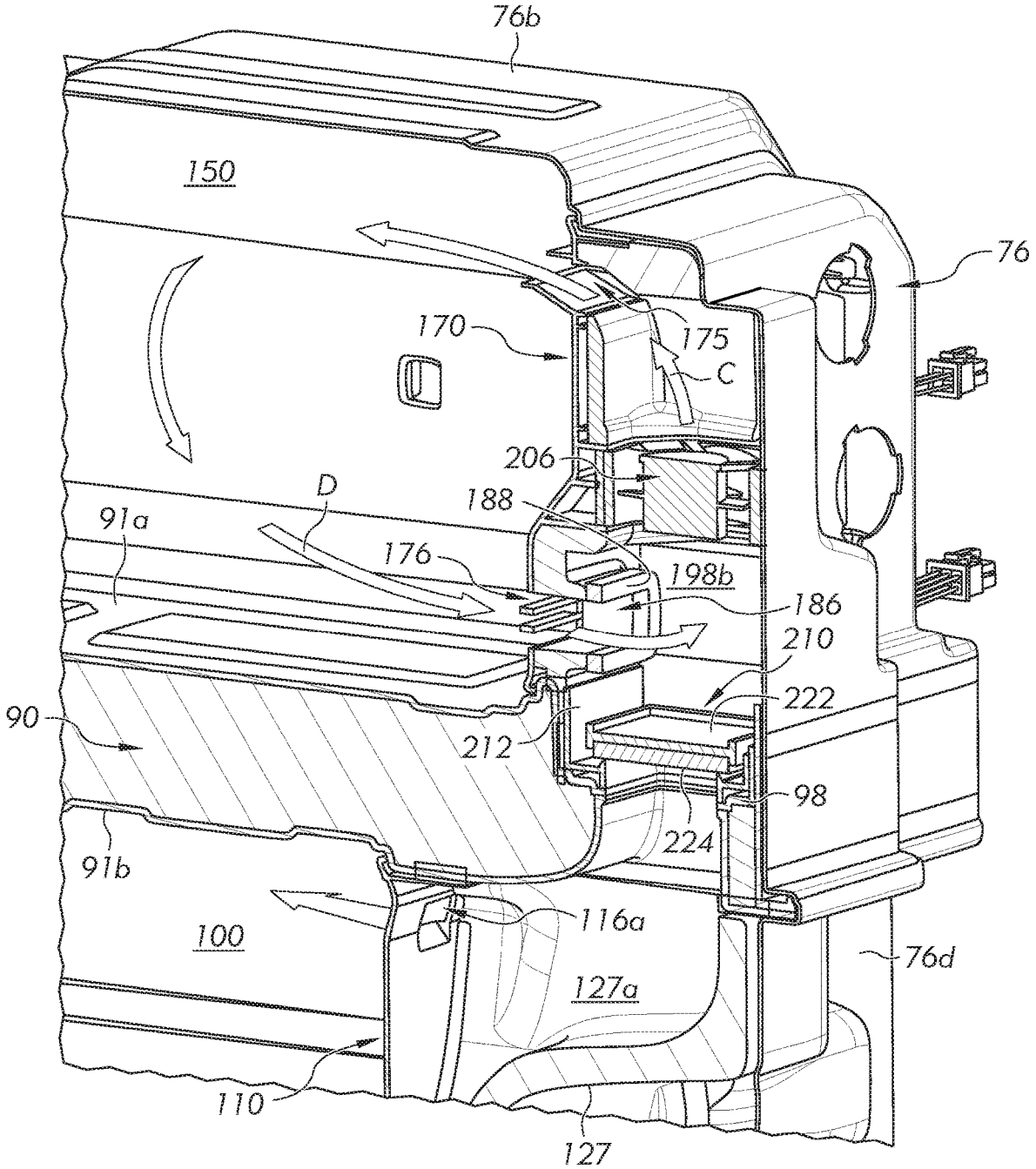
FIG. 9C is a sectioned side view taken along lines 9B-9B of FIG. 3A showing the damper door assembly in a closed position.

Referring to FIGS. 9B and 9C, the damper assembly 210 is dimensioned to be received into the second opening 94 of the partition 90 such that the opening 214 of the damper assembly 210 is in registry with the open lower end 199 of the elongated channel 196. It is contemplated that the seat 98 formed in the second opening 94 may be dimensioned such that the frame 212 of the damper assembly 210 rests on the seat. When the damper door 222 is in the upper position (FIG. 9B), the damper door 222 engages the seal element 188 on the body 182 and hinders air from flowing through the first inlet 176. When the damper door 222 is in the lower position (FIG. 9C), the damper door 222 engages the frame 212 and hinders air from flowing through the opening 214 of the damper assembly 210 into the vertical portion 198*b* of the elongated channel 196.

Referring to FIGS. 9A-9C, the temperature control system 170 of the VCZ compartment 150 is positioned in the lower compartment 76 above the partition 90. It is contemplated that the plurality of tabs 179 on the cover 172 of the temperature control system 170 (FIG. 7F) and the plurality of upper recesses 87 on the side walls 76*a* of the lower compartment 76 (FIG. 3B) may be positioned and dimensioned to align with each other and engage in a snap-fit fashion. It is also contemplated that the plurality of tabs (not shown) along the bottom of the cover 172 and the recesses 96 in the partition 90 (FIG. 4B) may be positioned and dimensioned to align with each other and engage in a snap-fit fashion. The bosses 172*b* in the cover 172 (FIG. 7F) and the holes 191 in the body 182 (FIG. 7C) may be positioned and dimensioned such that the bosses 172*b* extend through the holes 191 in the body 182. The mounting holes 173 in the bosses 172*b* may be positioned in registry with the upper mounting holes 79 in the lower compartment 76 (FIG. 4B) so that fasteners (not shown) may extend through the cover 172 and into the rear wall 76*d* of the lower compartment 76 to secure the temperature control system 170 to the lower compartment 76. Referring to FIG. 9A, the rear surface 182*b* of the body 182 of the temperature control system 170 is positioned to abut the rear wall 76*d* of the lower compartment 76. In particular, the walls 202 that define the elongated channel 196 are positioned to extend into the second recess 84 and to contact that rear wall 76*d* so that the rear wall 76*d* will close the elongated channel 196. It is contemplated that the seal element 232 may be positioned between the distal ends of the plurality of walls 202 and the rear wall 76*d* to define a seal between the walls 202 and the rear wall 76*d*.

The second inlet 177 and the opening 187 of the temperature control system 170 are positioned and dimensioned to be in registry with the first recess 82 of the liner 72, which in turn, is in registry with the first opening 92 in the partition 90. The second inlet 177, the opening 187 and the first opening 92 together define a portion of the flow path "B" that extends from the VCZ compartment 150, through the temperature control system 170 and through the partition 90 towards the freezer compartment 100.

Referring to FIG. 9B, the fan 206 of the temperature control system 170 is positioned to be captured between the rear surface 182*b* of the body 182 and the rear wall 76*d* of the lower compartment 76. As shown in FIGS. 9A and 9B, the rear surface 182*b* (in particular, the walls 202 that define the elongated channel 196) and the rear wall 76*d* define an upper portion of the flow path "C" therebetween that directs airflow into the VCZ compartment 150. It is contemplated that the elongated channel 196 may be surrounded by the body 182 such that the elongated channel 196 alone defines the upper portion of the flow path "C." The damper assembly 210 of the temperature control system 170 is positioned to be in registry with the second opening 94 of the partition 90. The second opening 94 of the partition, the opening 214 of the damper assembly 210 and the elongated channel 196 together define the upper portion of the flow path "C" that extends from the partition 90, through the temperature control system 170 and into the VCZ compartment 150.

Operation

The VCZ compartment 150 will now be described with respect to the operation of the same. As described above, the freezer cooling module 110 is configured to supply cold air to the both the freezer compartment 100 and the VCZ compartment 150, hereinafter referred to as a Dual Cooling Mode of the refrigerator 50. In the Dual Cooling Mode, the control unit (not shown) of the refrigerator 50 causes the damper door 222 to be in the second or upper position (FIGS. 8, 9B). The controller also causes a refrigerant to be circulated through the freezer evaporator 132 and energizes the freezer fan 128. It is contemplated that the fan 206 may also be energized to improve the air flow supply to the VCZ compartment 150.

Referring initially to FIG. 6B, the control unit causes the fan 128 to rotate such that inlet air is drawn along the flow path "A." In particular, air in the freezer compartment 100 is drawn through the space between the flange 117 and the sloped portion 86 of the bottom wall 76*c* of the lower compartment 76. The air is drawn into the space 133 below the evaporator 132. Referring to FIG. 9A, the fan 128 also causes inlet air to be drawn from the VCZ compartment 150 through the second inlet 177 of the temperature control system 170 along the flow path "B." This air is drawn downwardly through the first opening 92 of the partition 90.

Referring back to FIG. 6B, the air from the flow path "B" is drawn into the space 133 below the evaporator 132 to mix with the air drawn from the freezer compartment 100. This mixed air is then drawn over the evaporator 132 which removes heat from the air. The fan 128 then forces the air into the space bounded by the recessed cavity 122 and the cover 114. Referring to FIG. 5C, a portion of the air flows along the branches 126*b*, 126*c* and exits through the openings 116*a*, 116*b* in the cover 114 and into the freezer compartment 100. Arrows in FIG. 6B are used to represent the air exiting the openings 116*a*, 116*b*.

Referring now to FIG. 9B, a remaining portion of the air is forced out of the freezer cooling module 110 along the flow path "C." As noted above, the damper door 222 is in the upper position. In this position the damper door 222 engages the seal element 188 and obstructs the first inlet 176 of the cover 172 while allowing air to flow through the opening 214 of the damper assembly 210. The air then enters the temperature control system 170 wherein the fan 206 causes the air to be conveyed along the upper portion of the flow path "C," i.e., along the elongated channel 196 to the openings 184, 185.

Referring to FIGS. 7C, 9A and 9B, the air in the upper portion of the flow path "C" exits through outlets 174, 175 in the cover 172 of the temperature control system 170 and into the VCZ compartment 150. Arrows are used in FIGS. 9A and 9B to represent the air exiting the temperature control system 170 through outlets 174, 175. The air in the VCZ compartment 150 is returned back to the freezer evaporator 132 along the flow path "B," as described in detail above. The air continues to be circulated as described above until each of the freezer compartment 100 and VCZ compartment 150 are cooled to their respective desired temperatures.

Referring to FIG. 9C, once a desired cool temperature is reached in the VCZ compartment 150 (i.e., as preselected via the user interface 162), the control unit may initiate a mode wherein the air in the VCZ compartment 150 and the air in the freezer compartment 100 are independently circulated. To isolate the VCZ compartment 150 and the freezer compartment 100, the control unit may cause the damper door 222 to move to the first or lower position such that cold air from the freezer cooling module 110 is no longer supplied to the VCZ compartment 150. It is contemplated that the control unit may continue to energize the fan 206 such that air is drawn from the VCZ compartment 150 into the temperature control system 170 through the first inlet 176 along a flow path "D," (FIG. 9C). The fan 206 then causes the air to be circulated back into the VCZ compartment 150 along the elongated channel 196 and exit the temperature control system 170 through the outlets 174, 175 of the cover 172. In this respect, the fan 206 causes the air in the VCZ compartment 150 to circulate in a closed loop circulation path between the VCZ compartment 150 and the temperature control system 170 to maintain the preselected temperature. It is also contemplated that the fan 206 may be de-energized such that the air does not circulate within the VCZ compartment 150. Optionally, if the VCZ compartment 150 warms slightly over time, the control unit may cause the damper door 222 to open partially or even completely to intake additional cold air from the freezer to achieve the preselected temperature again. It is contemplated that the damper door 222 can be selectively opened and closed as necessary to maintain the temperature of the VCZ compartment 150 over time.

The control unit may also continue to energize the freezer fan 128 and convey the refrigerant through the freezer evaporator 132 to maintain the freezer compartment 100 at a lower temperature than the VCZ compartment 150. The operation of the freezer fan 128 causes the air in the freezer compartment 100 to circulate in a closed loop path between the freezer compartment 100 and the freezer evaporator 132.

During another mode of operation, hereinafter referred to as the Heat VCZ Compartment Mode, the control unit may cause both the heater 194 and the fan 206 of the temperature control system 170 to be energized. When energized, the heater 194 causes the temperature of the body 182 to increase. This increase in temperature, in turn, causes an increase in the temperature of the air within the body 182 of the temperature control system 170. This heated air is then conveyed into VCZ compartment 150 by the fan 206. The heater 194, and optionally the fan 206 may remain energized until the temperature in the VCZ compartment 150 is warmed to the desired temperature. Optionally, the damper door 222 may be in the closed position to obstruct cold air from the freezer. If desired, the temperature in the VCZ compartment 150 may be reduced by implementing the Dual Cooling Mode, as described in detail above. It is contemplated that the control unit may be programmed to alternate between the Dual Cooling Mode and the Heat VCZ Compartment Mode to maintain the VCZ compartment at the desired temperature. It is also contemplated that the Heat VCZ Compartment Mode may find particular application in raising the temperature of the VCZ compartment 150 quickly, if desired.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims and their equivalents.

The invention claimed is:

1. A refrigeration appliance comprising:

a liner defining a compartment for storing food items in a refrigerated environment, a rear wall of the liner contoured to define a first vertical recess therein;

a partition insertable into said compartment to divide said compartment into an upper compartment and a lower compartment, said lower compartment having a user-selectable target freezer temperature, said upper compartment having a user-selectable target variable climate zone temperature between a predetermined temperature below 0 degrees Centigrade and a predetermined temperature above 0 degrees Centigrade, the partition including:

a first protrusion extending from a rear edge of the partition, the first protrusion disposed in the first vertical recess in the liner when the partition is positioned in the compartment, a first opening extending through the first protrusion from an upper surface of the partition to a lower surface of the partition, the first opening aligned with the first vertical recess in the liner, a temperature control system positioned in the upper compartment, the temperature control system comprising:

a vertical partition having a front surface and a rear surface, the rear surface facing the rear wall of the liner and the front surface facing an open end of the upper compartment, at least one lower opening extending through the front surface of the vertical partition and fluidly communicating with an upper end of the first vertical recess in the liner and the first opening extending through the partition, an evaporator disposed in the lower compartment; and an evaporator fan disposed in the lower compartment for drawing air from the upper compartment through the at least one lower opening in the vertical partition, through the first vertical recess in the liner and through the first opening extending through the partition and exhausting the air into the lower compartment.

2. The refrigeration appliance of claim 1, further comprising:

a U-shaped air duct positioned in the lower compartment over the first vertical recess to enclose a portion of the first vertical recess in the lower compartment.

3. The refrigeration appliance of claim 2, wherein the U-shaped air duct is positioned between the evaporator and the rear wall of the liner.

4. The refrigeration appliance of claim 1, wherein the partition is not a foamed partition wall.

5. The refrigeration appliance of claim 1, wherein the liner further defines a second compartment disposed above the compartment and a foamed second partition wall separates the second compartment from the compartment.

6. The refrigeration appliance of claim 5, wherein the second compartment is a fresh food compartment.

7. The refrigeration appliance of claim 1, wherein the liner includes a second vertical recess, the partition includes:

a second protrusion extending from a rear edge of the partition, the second protrusion disposed in the second vertical recess in the liner when the partition is positioned in the compartment, and a second opening extending through the second protrusion from the upper surface of the partition to the lower surface of the partition, the second opening aligned with the second vertical recess in the liner, the temperature control system includes:

an air passage formed in the vertical partition extending from a lower portion of the vertical partition to an upper portion of the vertical partition, a lower end of the air passage aligned with the second opening in the partition between the upper compartment and the lower compartment, and at least one upper opening extending through the front surface of the vertical partition to an upper end of the air passage, wherein the evaporator fan disposed in the lower compartment conveys cooling air from the evaporator through the second opening in the partition, through the air passage in the vertical partition and through the at least one upper opening in the vertical partition and exhausts the cooling air into the upper compartment.

8. The refrigeration appliance according to claim 7, further comprising a circulation fan positioned in the air passage for conveying air therealong.

9. The refrigeration appliance according to claim 7, further comprising a heater assembly disposed between the front surface and the rear surface of the vertical partition proximate the air passage wherein air in the air passage is heated by the heater assembly when the heater assembly is energized.

10. The refrigeration appliance of claim 7, wherein a rear portion of the vertical partition extends into the second vertical recess and a corresponding surface of the liner defines a boundary of the air passage through the vertical partition.

11. The refrigeration appliance of claim 7, wherein a damper assembly is disposed in the second opening, the damper assembly including a damper door moveable between an open position for allowing air to flow through the second opening and a closed position for hindering air flow through the second opening.

12. A refrigeration appliance comprising:

a liner defining a compartment for storing food items in a refrigerated environment, a rear wall of the liner contoured to define a vertical recess therein;

a partition insertable into said compartment to divide said compartment into an upper compartment and a lower compartment, said lower compartment having a target freezer temperature, said upper compartment having a user-selectable target variable climate zone temperature between a predetermined temperature below 0 degrees Centigrade and a predetermined temperature above 0 degrees Centigrade, the partition including:

a protrusion extending from a rear edge of the partition, the protrusion disposed in the vertical recess in the liner when the partition is positioned in the compartment, and an opening extending through the protrusion from an upper surface of the partition to a lower surface of the partition, the opening aligned with the vertical recess in the liner;

a temperature control system positioned in the upper compartment, the temperature control system comprising:

a vertical partition having a front surface and a rear surface, the rear surface facing the rear wall of the liner and the front surface facing an open end of the upper compartment, an air passage formed in the vertical partition extending from a lower portion of the vertical partition to an upper portion of the vertical partition, a lower end of the air passage aligned with the opening in the partition between the upper compartment and the lower compartment, and at least one upper opening extending through the front surface of the vertical partition to an upper end of the air passage;

an evaporator disposed in the lower compartment; and an evaporator fan disposed in the lower compartment for conveying cooling air from the evaporator through the opening in the partition, through the air passage in the vertical partition and through the at least one upper opening in the vertical partition and exhausting the cooling air into the upper compartment.

13. The refrigeration appliance according to claim 12, further comprising a circulation fan positioned in the air passage for conveying air therealong.

14. The refrigeration appliance according to claim 12, further comprising a heater assembly disposed between the front surface and the rear surface of the vertical partition proximate the air passage wherein air in the air passage is heated by the heater assembly when the heater assembly is energized.

15. The refrigeration appliance of claim 12, wherein the partition is not a foamed partition wall.

16. The refrigeration appliance of claim 12, wherein the liner further defines a second compartment disposed above the compartment and a foamed second partition wall separates the second compartment from the compartment.

17. The refrigeration appliance of claim 16, wherein the second compartment is a fresh food compartment.

18. The refrigeration appliance of claim 12, wherein a rear portion of the vertical partition extends into the vertical recess and a corresponding surface of the liner defines a boundary of the air passage through the vertical partition.

19. The refrigeration appliance of claim 12, wherein the liner includes an additional vertical recess, the partition includes:

an additional protrusion extending from a rear edge of the partition, the additional protrusion disposed in the additional vertical recess in the liner when the partition is positioned in the compartment, and an additional opening extending through the additional protrusion from an upper surface of the partition to a lower surface of the partition, the additional opening aligned with the additional vertical recess in the liner; and the temperature control system including:

at least one lower opening extending through the front surface of the vertical partition and fluidly communicating with an upper end of the additional vertical recess in the liner and the additional opening extending through the partition, wherein the evaporator fan disposed in the lower compartment draws air from the upper compartment through the at least one lower opening in the vertical partition, through the additional vertical recess in the liner and through the additional opening extending through the partition and exhausts the air into the lower compartment.

20. The refrigeration appliance of claim 19, further comprising:

a U-shaped air duct positioned in the lower compartment over the additional vertical recess to enclose a portion of the additional vertical recess in the lower compartment.

21. The refrigeration appliance of claim 20, wherein the U-shaped air duct is positioned between the evaporator and the rear wall of the liner.

* * * * *